US008426351B2

(12) United States Patent
Okada et al.

(10) Patent No.: US 8,426,351 B2
(45) Date of Patent: Apr. 23, 2013

(54) LIQUID SOFTENER COMPOSITION OR TRANSPARENT OR SEMITRANSPARENT LIQUID SOFTENER COMPOSITION

(75) Inventors: Kyoko Okada, Wakayama (JP); Takahiro Osumi, Wakayama (JP); Kazutaka Shiratsuchi, Wakayama (JP); Noriaki Ushio, Wakayama (JP); Kouji Ohsaki, Wakayama (JP)

(73) Assignee: Kao Corporation, Tokyo (JP)

( * ) Notice: Subject to any disclaimer, the term of this patent is extended or adjusted under 35 U.S.C. 154(b) by 573 days.

(21) Appl. No.: 12/518,579

(22) PCT Filed: Dec. 12, 2007

(86) PCT No.: PCT/JP2007/074364

§ 371 (c)(1),
(2), (4) Date: Jul. 1, 2009

(87) PCT Pub. No.: WO2008/072780

PCT Pub. Date: Jun. 19, 2008

(65) Prior Publication Data

US 2010/0017970 A1 Jan. 28, 2010

(30) Foreign Application Priority Data

Dec. 12, 2006 (JP) ..... 2006-334231
Dec. 12, 2006 (JP) ..... 2006-334232
Feb. 23, 2009 (JP) ..... 2007-43922

(51) Int. Cl.
*C11D 1/62* (2006.01)
*C11D 3/37* (2006.01)

(52) U.S. Cl.
USPC ..... 510/515; 510/327; 510/328; 510/329; 510/361; 510/398

(58) Field of Classification Search ..... 510/327, 510/328, 329, 361, 398, 515
See application file for complete search history.

(56) References Cited

U.S. PATENT DOCUMENTS

| | | | | |
|---|---|---|---|---|
| 3,416,952 | A | 12/1968 | McIntyre et al. | |
| 3,557,039 | A | 1/1971 | McIntyre et al. | |
| 4,795,584 | A | 1/1989 | Ross et al. | |
| 6,020,304 | A * | 2/2000 | Ceulemans et al. | 510/527 |
| 6,379,394 | B1 | 4/2002 | Chilou et al. | |
| 6,525,034 | B2 * | 2/2003 | Dalrymple et al. | 514/77 |
| 2003/0211960 | A1 | 11/2003 | Smets | |
| 2004/0097397 | A1 | 5/2004 | Mohr et al. | |
| 2004/0110648 | A1 * | 6/2004 | Jordan et al. | 510/101 |
| 2004/0152618 | A1 | 8/2004 | Mistry et al. | |
| 2005/0065057 | A1 * | 3/2005 | Cauwberghs et al. | 510/473 |
| 2005/0130872 | A1 * | 6/2005 | Cooper et al. | 510/504 |
| 2005/0245668 | A1 | 11/2005 | Green et al. | |
| 2006/0135399 | A1 * | 6/2006 | Grandmaire et al. | 510/515 |
| 2006/0168739 | A1 * | 8/2006 | Caswell et al. | 8/115.51 |
| 2006/0287216 | A1 | 12/2006 | Song | |
| 2007/0202069 | A1 * | 8/2007 | Tamareselvy et al. | 424/70.12 |
| 2008/0233069 | A1 * | 9/2008 | Tamareselvy et al. | 424/70.11 |
| 2010/0009894 | A1 * | 1/2010 | Leclerc et al. | 510/516 |

FOREIGN PATENT DOCUMENTS

| | | | |
|---|---|---|---|
| EP | 0 458 59 | A2 | 5/1991 |
| EP | 1 111 034 | A1 | 6/2001 |
| JP | 4-228680 | A | 8/1992 |
| JP | 6-228883 | A | 8/1994 |
| JP | 6-256794 | A | 9/1994 |
| JP | 11-508319 | A | 7/1999 |
| JP | 2000-503735 | A | 3/2000 |
| JP | 2001-524616 | A | 12/2001 |
| JP | 3253972 | B2 | 2/2002 |
| JP | 2004-500451 | A | 1/2004 |
| JP | 2004-175882 | A | 6/2004 |
| JP | 2004-197241 | A | 7/2004 |
| JP | 2004-535491 | A | 11/2004 |
| JP | 2005-528538 | A | 9/2005 |
| JP | 2006-512471 | A | 4/2006 |
| JP | 2006-161215 | A | 6/2006 |
| WO | WO-97/31085 | A1 | 8/1997 |
| WO | WO-97/42285 | A1 | 11/1997 |
| WO | WO-98/12293 | A1 | 3/1998 |
| WO | WO-99/27050 | A1 | 6/1999 |
| WO | WO-02/102951 | A1 | 12/2002 |
| WO | WO-03/102043 | A1 | 12/2003 |
| WO | WO-2004/25017 | A1 | 3/2004 |
| WO | WO 2004/056888 | A2 | 7/2004 |

OTHER PUBLICATIONS

Japanese Office Action with the English translation dated Sep. 20, 2011, for Application No. 2006-334231.
Japanese Office Action with the English translation dated Sep. 20, 2011, for Application No. 2006-334232.
Japanese Office Action with the English translation dated Sep. 20, 2011, for Application No. 2007-043922.
Extended European Search Report issued on Feb. 17, 2011 in corresponding European Patent Application No. 07 85 9853.

* cited by examiner

*Primary Examiner* — Charles Boyer
(74) *Attorney, Agent, or Firm* — Birch, Stewart, Kolasch & Birch, LLP

(57) ABSTRACT

The present invention provides a liquid softener composition having pH 2 to 5 at 20° C. and containing (a) a polymer compound having a weight-average molecular weight of 2,000 to 90,000 and containing specific monomer units (A) and (B) in a specific molar ratio, (b) one or more compounds selected from specific quaternary ammonium salts and amine compounds, and (c) at least one compound selected from water and solvents having a C log P value of 2 or less within specified ranges.

9 Claims, No Drawings

LIQUID SOFTENER COMPOSITION OR TRANSPARENT OR SEMITRANSPARENT LIQUID SOFTENER COMPOSITION

FIELD OF THE INVENTION

The present invention relates to a liquid softener composition capable of conferring softness on fiber products and a method of treating fiber products therewith.

BACKGROUND OF THE INVENTION

To make soil components easily releasable from fibers during washing, a treatment of previously adsorbing a base material onto fibers is conducted in some cases. When fibers are subjected to such treatment, a higher cleaning effect than in conventional washing can expected. The base material exhibiting such effect is generally called "soil release agent".

As to the soil release agent, various base materials have been proposed. For example, terephthalate-based compounds (U.S. Pat. No. 3,416,952, U.S. Pat. No. 3,557,039, U.S. Pat. No. 4,795,584) have been proposed.

Polyamine derivatives (WO-A 97/42285, JP-A 11-508319) and chitosan derivatives (JP-A2004-175882), amine crosslinked products (JP-A 2004-197241) etc. have also been proposed.

Further, JP-B 3253972 describes a soil-detaching agent consisting of a polysaccharide having a cationic group (ammonium etc.) and a hydrophobic group, and a polyvinyl alcohol.

JP-A 4-228680 proposes a fiber product treatment composition containing a deflocculating polymer having a hydrophilic main chain and one or more hydrophobic side chains, but does not describe a soil release effect.

JP-A 6-228883 describes a softener composition containing a polymer consisting of a monomer with a specific structure having an amino group.

It is not disclosed that fiber products treated with liquid softener compositions compounded with the soil release agents described in these literatures can be endowed not only with soil release performance but also with softening performance at satisfactory levels.

Softener compositions made transparent or semitransparent from an aesthetic viewpoint have been developed in recent years, and JP-A 2001-524616 discloses a technique of using a solvent having specific log P, and it is conceivable that these compositions attain transparency by micro-emulsification or solubilization of water-insoluble quaternary ammonium salt compounds with the specific solvent. JP-A 2006-161215 discloses a technique of using a nonionic surfactant having a specific structure together with a solvent having specific log P. WO-A 2004/025017 discloses that a liquid softener composition based on silicone can be made transparent.

Softener compositions made transparent or semitransparent from an aesthetic viewpoint have been developed in recent years. Conventional emulsified softener compositions have a water-insoluble softening main base dispersed in water in the form of particles having a diameter of several hundreds nanometers to several hundreds micrometers, and have a disadvantage that the composition is separated during long storage, while the transparent or semitransparent liquid softener compositions have an advantage that storage stability is dramatically improved by thermodynamically stable micro-emulsification or solubilization of the main base. JP-A 2001-524616 discloses a technique of using a solvent having specific log P, and it is conceivable that this technique achieves transparency by micro-emulsification or solubilization of water-insoluble quaternary ammonium salt compounds with the specific solvent. JP-A 2006-161215 discloses a technique of using a nonionic surfactant having a specific structure together with a solvent having specific log P. WO-A 2004/025017 discloses that a liquid softener composition based on silicone can be made transparent.

Meanwhile, techniques of improving softening performance by incorporating cationic polymers into softener compositions are known (WO-A 2004/025017, JP-A 2000-503735). It is also known that for coating on a soft base (JP-A 6-228883) and as a deflocculating polymer for viscosity regulation (JP-A 4-228680), a cationic polymer is incorporated into a softener.

SUMMARY OF THE INVENTION

The present invention relates to the following composition (1), (2) or (3).

The composition (1) of the present invention is a liquid softener composition having pH 2 to 5 at 20° C. and containing the following components (a1), (b1) and (c1), wherein the content of the component (a1) is 0.1 to 5.0% by mass, the content of the component (b1) is 4 to 25% by mass, and the content of the component (c1) is 20 to 95% by mass:

<Component (a1)>

A polymer compound having a weight-average molecular weight of 2,000 to 90,000 and containing a monomer unit (A1) derived from a compound represented by the following formula (1-1) or derived from an acid salt thereof and a monomer unit (B1) derived from a compound represented by the following formula (1-2) in an (A1)/(B1) molar ratio of from 55/45 to 98/2:

(1-1)

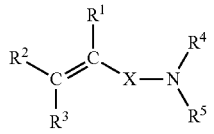

wherein $R^1$ and $R^2$ independently represent a hydrogen atom or a methyl group, $R^3$ represents a hydrogen atom or —COOM wherein M is a hydrogen atom or an alkali metal atom; X represents —COO—$R^6$—, —CONR$^7$—$R^8$—, or —$CH_2$—;

when X is —$CH_2$—, $R^4$ represents a group represented by the formula (1-3):

(1-3)

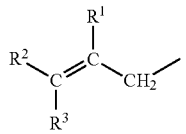

when X is other than —$CH_2$—, $R^4$ represents an alkyl group having 1 to 3 carbon atoms or a hydroxyalkyl group having 1 to 3 carbon atoms;

$R^5$ represents an alkyl group having 1 to 3 carbon atoms, a hydroxyalkyl group having 1 to 3 carbon atoms, or a hydrogen atom; $R^6$ and $R^8$ independently represent an alkyl group having 2 to 3 carbon atoms; and $R^7$ represents a hydrogen atom or an alkyl group having 1 to 3 carbon atoms, (1-2)

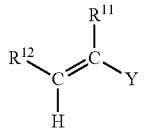

wherein $R^{11}$ and $R^{12}$ independently represent a hydrogen atom or an alkyl group having 1 to 3 carbon atoms, Y represents an aryl group, —O—CO—$R^{13}$, —COO—$R^{14}$, or —CONR$^{15}$—$R^{16}$ wherein $R^{13}$, $R^{14}$ and $R^{16}$ independently represent a linear, branched or cyclic alkyl or alkenyl group having 1 to 22 carbon atoms or an arylalkyl group having 6 to 14 carbon atoms in total, and $R^{15}$ represents a hydrogen atom or an alkyl group having 1 to 3 carbon atoms.

<Component (b1)>

At least one compound selected from compounds represented by the following formulae (1-4) and (1-5):

(1-4)

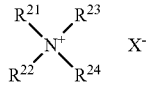

(1-5)

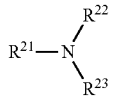

wherein $R^{21}$, $R^{22}$ and $R^{23}$ independently represent a hydrocarbon group having 14 to 26 carbon atoms in total which is interrupted by an ester group and/or an amide group, a hydroxyalkyl group having 1 to 3 carbon atoms, or an alkyl group having 1 to 3 carbon atoms, at least one of which is a hydrocarbon group having 14 to 26 carbon atoms in total which is interrupted by an ester group and/or an amide group; $R^{24}$ represents a hydrogen atom or an alkyl group having 1 to 3 carbon atoms; and $X^-$ represents an anionic group.

<Component (c1)>

At least one compound selected from water and solvents having a C log P value of 2 or less.

The composition (2) of the present invention is a transparent or semitransparent liquid softener composition containing the following components (a2), (b2) and (c2), wherein the content of the component (a2) is 0.01 to 5.0% by mass, the content of the component (b2) is 5 to 30% by mass, and the content of the component (c2) is 5 to 30% by mass:

<Component (a2)>

A polymer compound containing a monomer unit (A2) derived from a compound represented by the following formula (1-1) or derived from an acid salt thereof or a quaternary salt thereof and a monomer unit (B2) derived from a compound represented by the following formula (1-2) in an (A2)/(B2) molar ratio of from 20/80 to 99/1:

(1-1)

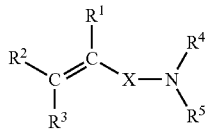

wherein $R^1$ and $R^2$ independently represent a hydrogen atom or a methyl group, $R^3$ represents a hydrogen atom or —COOM wherein M is a hydrogen atom or an alkali metal atom; X represents —COO—$R^6$—, —CONR$^7$—$R^8$—, or —$CH_2$—;

when X is —$CH_2$—, $R^4$ represents a group represented by the formula (1-3):

(1-3)

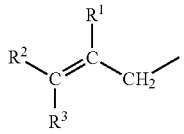

when X is other than —$CH_2$—, $R^4$ represents an alkyl group having 1 to 3 carbon atoms or a hydroxyalkyl group having 1 to 3 carbon atoms;

$R^5$ represents an alkyl group having 1 to 3 carbon atoms, a hydroxyalkyl group having 1 to 3 carbon atoms, or a hydrogen atom; $R^6$ and $R^8$ independently represent an alkyl group having 2 to 3 carbon atoms; and $R^7$ represents a hydrogen atom or an alkyl group having 1 to 3 carbon atoms, (1-2)

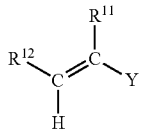

wherein $R^{11}$ and $R^{12}$ independently represent a hydrogen atom or an alkyl group having 1 to 3 carbon atoms, Y represents an aryl group, —O—CO—$R^{13}$, —COO—$R^{14}$, or CONR$^{15}$—$R^{16}$ wherein $R^{13}$, $R^{14}$ and $R^{16}$ independently represent a linear, branched or cyclic alkyl or alkenyl group having 1 to 22 carbon atoms or an arylalkyl group having 6 to 14 carbon atoms in total, and $R^{15}$ represents a hydrogen atom or an alkyl group having 1 to 3 carbon atoms.

<Component (b2)>

At least one compound selected from compounds represented by the following formulae (1-4) and (1-5):

(1-4)

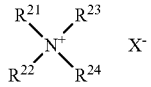

(1-5)

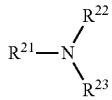

wherein $R^{21}$, $R^{22}$ and $R^{23}$ independently represent a hydrocarbon group having 14 to 26 carbon atoms in total which is interrupted by an ester group and/or an amide group, a hydroxyalkyl group having 1 to 3 carbon atoms, or an alkyl group having 1 to 3 carbon atoms, at least one of which is a hydrocarbon group having 14 to 26 carbon atoms in total which is interrupted by an ester group and/or an amide group; $R^{24}$ represents a hydrogen atom or an alkyl group having 1 to 3 carbon atoms; and $X^-$ represents an anionic group.

<Component (c2)>

An organic solvent having a log P value of −0.5 to 1.5.

The composition (3) of the present invention is a transparent or semitransparent liquid softener composition containing the following components (a3), (b3), (c3) and (d3), wherein the content of the component (a3) is 0.01 to 5.0% by mass, the content of the component (b3) is 5 to 30% by mass, the content of the component (c3) is 5 to 30% by mass, and the content of the component (d3) is 5 to 20% by mass:

<Component (a3)>

A polymer compound containing a structural unit derived from a compound represented by the following formula (1-1) or derived from an acid salt or quaternary salt monomer thereof:

(1-1)

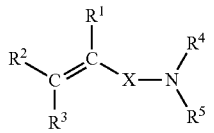

wherein $R^1$ and $R^2$ independently represent a hydrogen atom or a methyl group, $R^3$ represents a hydrogen atom or —COOM wherein M is a hydrogen atom or an alkali metal atom; X represents —COO—$R^6$—, —CONR$^7$—$R^8$—, or —$CH_2$—; and when X is —$CH_2$—, $R^4$ represents a group represented by the formula (1-3):

(1-3)

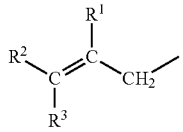

wherein $R^{11}$ and $R^{12}$ independently represent a hydrogen atom or an alkyl group having 1 to 3 carbon atoms, Y represents an aryl group, —O—CO—$R^{13}$, —COO—$R^{14}$ or —CONR$^{15}$—$R^{16}$ wherein $R^{13}$, $R^{14}$ and $R^{16}$ independently represent a linear, branched or cyclic alkyl or alkenyl group having 1 to 22 carbon atoms or an arylalkyl group having 6 to 14 carbon atoms in total, and $R^{15}$ represents a hydrogen atom or an alkyl group having 1 to 3 carbon atoms.

<Component (b3)>

At least one compound selected from compounds represented by the following formulae (1-4) and (1-5):

(1-4)

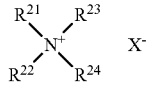

(1-5)

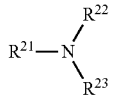

wherein $R^{21}$, $R^{22}$ and $R^{23}$ independently represent a hydrocarbon group having 14 to 26 carbon atoms in total which is interrupted by an ester group and/or an amide group, a hydroxyalkyl group having 1 to 3 carbon atoms, or an alkyl group having 1 to 3 carbon atoms, at least one of which is a hydrocarbon group having 14 to 26 carbon atoms in total which is interrupted by an ester group and/or an amide group; $R^{24}$ represents a hydrogen atom or an alkyl group having 1 to 3 carbon atoms; and $X^-$ represents an anionic group.

<Component (c3)>

An organic solvent having a log P value of −0.5 to 1.5.

<Component (d3)>

At least one compound selected from compounds represented by the following formulae (3-5) and (3-6):

(3-5)

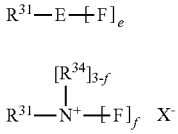

(3-6)

wherein $R^{31}$ represents an alkyl or alkenyl group having 6 to 18 carbon atoms or an aryl group; F represents —$(R^{32}O)_d$—$R^{33}$; $R^{32}$ represents an alkylene group having 2 or 3 carbon atoms; $R^{33}$ represents an alkyl group having 1 to 3 carbon atoms or a hydrogen atom; d is an average number of moles added and a number of 2 to 100; E is —O—, —COO—, —CON< or —N<, provided that when E is —O— or —COO—, e is 1, and when E is —CON< or —N<, e is 2; $R^{34}$ represents an alkyl group having 1 to 3 carbon atoms; f is 1 to 3; and $X^-$ represents an anionic group.

The present invention also relates to a method of treating a washed fiber product, which includes adding the liquid softener composition (1), (2) or (3) to an aqueous solution adjusted to pH 2 to 9.

The present invention also relates to a method of conferring softness and soil releasability on a fiber product, which includes adding the liquid softener composition (1) to an aqueous solution adjusted to pH 2 to 9 and treating a washed fiber product with the solution.

The present invention also relates to a method of washing fiber products treated with the liquid softener composition (1) (2) or (3), with a cleaning solution having a pH value of 9 to 13.

DETAILED DESCRIPTION OF THE INVENTION

The soil release agents in U.S. Pat. No. 3,416,952, U.S. Pat. No. 3,557,039, and U.S. Pat. No. 4,795,584 exhibit a high effect on hydrophobic synthetic fibers such as polyester-mixed fibers etc., but do not attain a sufficient effect on fibers having relatively high hydrophilicity such as cotton fibers.

The soil release agents in WO-A 97/42285, JP-A 11-508319, JP-A 2004-175882, and JP-A 2004-197241 strongly undergo the influences of various conditions such as a surfactant, temperature, mechanical strength, the amount of fibers treated, and the amount of a base added in a process of adsorption onto fibers or of cleaning by washing, thus often failing to attain a sufficient effect in the scene of actual use.

JP-B 3253972 and JP-A 6-228883 are still not satisfactory in the soil release effect.

A quaternary ammonium compound having an ester group based on an unsaturated fatty acid used as the main base in JP-A 2001-524616 is not satisfactory in softening performance as compared with the main base used in emulsified softener compositions.

For exhibiting softening performance, it is therefore necessary to incorporate the main base in a larger amount, which results in poor economic efficiency. Further, there occurs a problem of influencing qualities by the smell and color derived from raw unsaturated fatty acids in the compositions during storage.

The technique in JP-A 2006-161215 is excellent in an effect of preventing staining, but there is demand for further improvement for attaining both maintenance of transparency and softening effect.

The silicone compound used in WO-A 2004/025017, as compared with the quaternary ammonium compound, is not at satisfactory levels in respect of texture. That is, there is demand for compounds exhibiting a further excellent softening effect in transparent or semitransparent softener compositions. On the other hand, JP-A 2000-503735, JP-A 6-228883 and JP-A 4-228680 do not mention that liquid softeners are made transparent in appearance.

According to the present invention, fiber products are endowed with softening performance at satisfactory levels.

The liquid softener composition (1) of the present invention can confer not only softening performance at satisfactory levels on fiber products, but can also simultaneously confer an excellent soil-releasing effect. The liquid softener composition can exert the performance on objective fiber products including not only highly hydrophobic fibers such as polyester fibers, but also fibers having relatively high hydrophilicity such as cotton fibers.

The liquid softener composition (1) of the present invention relates to a liquid softener composition capable of conferring an excellent soil release effect on fiber products and simultaneously exhibiting softening performance at satisfactory levels, as well as a method of treating fiber products therewith.

The present invention relates to a transparent or semitransparent liquid softener composition.

The present invention provides a liquid softener composition which is transparent or semitransparent and exhibits an excellent softening effect.

The composition in the present invention is compounded with a cationic polymer having a specific structure, thereby reducing the amount of a quaternary ammonium compound having an ester group based on an unsaturated fatty acid and simultaneously being an able to exhibit sufficient softening performance and to maintain a transparent appearance.

The term "transparent" or "semitransparent" referred to in the present invention means that the light transmittance of the composition at a wavelength of 660 nm, as determined in a quartz cell having an optical path length of 10 mm as a measurement cell with a control cell being charged with deionized water, is 30% or more.

In the present invention, the amount of a quaternary ammonium compound having an ester group based on an unsaturated fatty acid is reduced, while sufficient softening performance is exhibited by incorporating a cationic polymer having a specific structure, and a transparent appearance, which is hardly achieved when the cationic polymer having a specific structure is incorporated, can be achieved by incorporating a nonionic surfactant having a specific structure and a cationic surfactant.

The term "transparent" or "semitransparent" referred to in the present invention means that the light transmittance of the composition at a wavelength of 660 nm, as determined in a quartz cell having an optical path length of 10 mm as a measurement cell with a control cell being charged with deionized water, is 30% or more.

The liquid softener composition of the present invention can maintain a transparent or semitransparent appearance and simultaneously exhibit an excellent softening effect.

Hereinafter, the composition (1), (2) or (3) of the present invention will be described.

First, the composition (1) of the present invention will be described.

<Component (a1)>

Among the compounds represented by the formula (1-1) from which the monomer unit (A1) is derived, the compounds of the formula (1-1) wherein X represents —COO—$R^6$— include N,N-dimethylaminoethyl acrylate, N,N-dimethylaminomethyl acrylate, N,N-dimethylaminobutyl acrylate, N,N-dimethylaminopropyl acrylate, N,N-dimethylaminoethyl methacrylate, N,N-dimethylaminomethyl methacrylate, N,N-dimethylaminobutyl methacrylate, N,N-dimethylaminopropyl methacrylate, N,N-diethylaminoethyl acrylate, N,N-diethylaminomethyl acrylate, N,N-diethylaminobutyl acrylate, N,N-diethylaminopropyl acrylate, N,N-diethylaminoethyl methacrylate, N,N-diethylaminomethyl methacrylate, N,N-diethylaminobutyl methacrylate, and N,N-diethylaminopropyl methacrylate.

Among the compounds represented by the formula (1-1), the compounds of the formula (1-1) wherein X represents —CONR$^7$—R$^8$— include N,N-dimethylaminopropyl acrylic acid (or methacrylic acid) amide, N,N-dimethylaminomethyl acrylic acid (or methacrylic acid) amide, N,N-dimethylaminoethyl acrylic acid (or methacrylic acid) amide, and N,N-dimethylaminobutyl acrylic acid (or methacrylic acid) amide.

When X in the formula (1-1) is —$CH_2$—, $R^4$ is a group represented by the formula (1-3). Such compounds include diallylamine, and diallylmethylamine.

As the compound represented by the formula (1-1), its acid salt can be used. The acid salt includes neutralized salts of inorganic salts such as primary, secondary and tertiary amine hydrochlorides and sulfates, and neutralized salts of various organic acid salts.

The most preferable compounds are N,N-dimethylaminoethyl methacrylate, N,N-dimethylaminomethyl methacrylate, N,N-dimethylaminoethyl acrylate, and N,N-dimethylaminomethyl acrylate.

The compound represented by the formula (1-2) from which the monomer unit (B1) is derived includes alkyl (C1 to C22) acrylates such as lauryl acrylate, alkyl (C1 to C22) methacrylates such as butyl methacrylate, methyl methacrylate and lauryl methacrylate, and styrene. Among them, alkyl (C8 to C18) acrylates, alkyl (C8 to C18) methacrylates, and styrene are preferable, and alkyl (C12 to C18) acrylates and alkyl (C12 to C18) methacrylates are more preferable.

The component (a1) may have a monomer unit (monomer unit (C1)) derived from a copolymerizable unsaturated bond-containing monomer (monomer (C1)) as a monomer unit other than the monomer units (A1) and (B1) in such a range that the effect of the present invention is not impaired. Examples of such monomer (C1) include acrylamide and vinyl alcohol; (meth)acrylates or (meth)acrylamides having a C1 to C22 hydroxyalkyl group, such as hydroxyethyl(meth) acrylate and hydroxypropyl(meth)acrylamide; (meth)acrylates having a polyalkylene (the number of carbon atoms in the alkylene group, 1 to 8; linear or branched chain) oxide chain, such as polyethyleneglycol(meth)acrylate, methoxypolyethyleneglycol(meth)acrylate, lauroxypolyethyleneglycol(meth)acrylate (polymerization degree of ethylene glycol: 1 to 100), polypropyleneglycol(meth)acrylate (polymerization degree of propylene glycol: 1 to 50) and polybutyleneglycol(meth)acrylate (polymerization degree of butylene glycol: 1 to 50); polyhydric alcohol(meth)acrylates such as glycerin(meth)acrylate; diacetone(meth)acrylamide; N-vinyl cyclic amides such as N-vinyl pyrrolidone; N-(meth)acryloyl morpholine; vinyl chloride; acrylonitrile; vinyl compounds having a carboxyl group, such as (meth)acrylic acid, maleic acid, itaconic acid, and styrenecarboxylic acid; and vinyl compounds having a sulfonic acid group, such as 2-acrylamide-2-methylpropanesulfonic acid and styrenesulfonic acid. When the component (a1) is a polymer containing the monomer (C1), the total proportion of the monomers (A1) and (B1) in the polymer is 60% or more, preferably 70% or more, in terms of molar ratio from the viewpoint of both softening performance and soil release performance.

The component (a1) contains the monomer unit (A1) and the monomer unit (B1) in an (A1)/(B1) molar ratio of 55/45 to 98/2, preferably 60/40 to 95/5, more preferably 70/30 to 90/10, from the viewpoint of soil-releasing effect and softening effect.

The weight-average molecular weight (Mw) of the component (a1) is 2,000 to 90,000, preferably 3,000 to 45,000, more preferably 3,000 to 30,000, even more preferably 3,000 to 20,000.

The Mw of the component (a1) used in the present invention is a value determined by gel permeation chromatography (GPC). The eluent used is water, alcohol, chloroform, dimethylformamide, tetrahydrofuran, acetonitrile, or a liquid consisting of a combination of these solvents, to determine a polyethylene oxide- or polystyrene-equivalent molecular weight.

When the polymer as the subject of measurement is measured by the following measurement method A, the method is used to calculate a molecular weight. When the molecular weight cannot be determined due to problems such as solubility in a solvent, the following measurement method B is used to calculate a molecular weight.

Measurement Method A

The molecular weight is calculated as a polyethylene glycol-equivalent molecular weight with 2 GPC columns "α-M" for polar solvent (manufactured by Tosoh Corporation) connected in series by using, as a solvent, 50 mmol/L LiBr solution prepared in a mixed solvent of (1% acetic acid/ethanol):water=3:7 (mass ratio)

Measurement Method B

The molecular weight is calculated as a polystyrene-equivalent molecular weight with 2 GPC columns "K-804" for organic solvent (manufactured by Showa Denko K.K.) connected in series by using 1 mmol/L Farmin DM20 (manufactured by Kao Corporation) solution in $CHCl_3$.

<Component (b1)>

The component (b1) is at least one compound selected from the compounds represented by the formula (1-4) (that is, the compound of the formula (1-4) wherein $R^{24}$ represents an alkyl group having 1 to 3 carbon atoms (referred to hereinafter as compound (b1)) and the compound of the formula (1-4) wherein $R^{24}$ represents a hydrogen atom (referred to hereinafter as compound (b2))) and the compound represented by the formula (1-5) (referred to hereinafter as compound (b3)).

In the formulae (1-4) and (1-5), $R^{21}$, $R^{22}$, $R^{23}$, and $R^{24}$ have the same meanings as defined above. That is, the groups represented by $R^{21}$, $R^{22}$ and $R^{23}$ in the formulae (1-4) and (1-5) are any of the following groups:

(i) a saturated hydrocarbon group having 14 to 26 carbon atoms in total which is interrupted by an ester group and/or an amide group (referred to hereinafter as group (i)), (ii) an unsaturated hydrocarbon group having 1 or more double bonds and having 14 to 26 carbon atoms in total which is interrupted by an ester group and/or an amide group (referred to hereinafter as group (ii)), (iii) a hydroxyalkyl group having 1 to 3 carbon atoms (referred to hereinafter as group (iii)), and (iv) an alkyl group having 1 to 3 carbon atoms (referred to hereinafter as group (iv)).

At least one of these groups is a group selected from the groups (i) and (ii). From the viewpoint of maintenance of transparency and softening effect, the group (i) or (ii) is preferably a group which is interrupted by an ester group.

When the appearance of the liquid softener composition of the present invention is transparent, it is established from the viewpoint of the transparent appearance that, in $R^{21}$, $R^{22}$ and $R^{23}$, the molar ratio of the saturated hydrocarbon group having 14 to 26 carbon atoms in total which is interrupted by an ester group and/or an amide group (group (i)) to the total of the saturated hydrocarbon group having 14 to 26 carbon atoms in total which is interrupted by an ester group and/or an amide group (group (i)) and the unsaturated hydrocarbon group having 1 or more double bonds and having 14 to 26 carbon atoms in total which is interrupted by an ester group and/or an amide group (group (ii)), that is, the group (i)/(the group (i)+the group (ii))×100, is preferably 12 mol % or less, more preferably 10 mol % or less, even more preferably 7 mol % or less, even more preferably 5 mol % or less, and even more preferably 3 mol % or less. From the viewpoint of maintaining storage stability, it is established that, in $R^{21}$, $R^{22}$ and $R^{23}$, the molar ratio of the unsaturated hydrocarbon group having one double bond and having 14 to 26 carbon atoms in total which is interrupted by an ester group and/or an amide group (referred to hereinafter as group (ii-1)) to the total of the group (i) and the group (ii), that is, the group (ii-1)/(the group (i)+the group (ii))×100, is preferably 70 mol % or more, more preferably 75 mol % or more, and even more preferably 80 mol % or more.

When the appearance of the liquid softener composition of the present invention is opaque, it is established from the viewpoint of storage stability that, in $R^{21}$, $R^{22}$ and $R^{23}$, the molar ratio of the saturated hydrocarbon group having 14 to 26 carbon atoms in total which is interrupted by an ester group and/or an amide group (group (ii)) to the total of the saturated hydrocarbon group having 14 to 26 carbon atoms in total which is interrupted by an ester group and/or an amide group (group (i)) and the unsaturated hydrocarbon group having 1 or more double bonds and having 14 to 26 carbon atoms in total which is interrupted by an ester group and/or an amide group (group (ii)), that is, the group (ii)/(the group (i)+the group (ii))×100, is preferably less than 70 mol %, more preferably 60 mol % or less, and even more preferably 50 mol % or less.

From the viewpoint of maintaining storage stability, it is established that, in $R^{21}$, $R^{22}$ and $R^{23}$, the molar ratio of an unsaturated hydrocarbon group having 2 or more double bonds and having 14 to 26 carbon atoms in total which is interrupted by an ester group (referred to hereinafter as group (ii-2)) to the total of the group (i) and the group (ii), that is, the group (ii-2)/(the group (i)+the group (ii))×100, is preferably 15 mol % or less, more preferably 10 mol % or less, and even more preferably 8 mol % or less.

In the formula (1-4), the anionic group represented by $X^-$ includes a halogen ion, a sulfate ion, an ion of a fatty acid having 1 to 12 carbon ions or of an alkyl sulfate having 1 to 3 carbon atoms, among which a halogen ion or an ion of an alkyl sulfate having 1 to 3 carbon atoms is preferable.

When a fatty acid or a fatty acid lower alkyl ester having the preferable hydrocarbon composition described above cannot be obtained by using a fatty acid such as one usually known in Fat and Oil Handbook or the like, the intended fatty acid or fatty acid lower alkyl ester can be obtained by isomerization reaction of unsaturated bonds or by using a mixture of such fatty acids.

To regulate the content of an unsaturated hydrocarbon group having 2 or more double bonds in the starting fatty acid or fatty acid lower alkyl ester, crystallization as described in, for example, JP-A 4-306296, a method in which a methyl ester is distilled under reduced pressure as described in JP-A 6-41578 or a selective hydrogenating reaction as described in JP-A 8-99036 can be carried out.

The molar ratio of a fatty acid or a fatty acid lower alkyl ester to a hydroxyl group and primary amino group of an alkanolamine in the esterification reaction or ester exchange reaction is preferably 0.3:1.0 to 1.2:1.0, more preferably 0.45:1.0 to 1.0:1.0, and even more preferably 0.5:1.0 to 0.98:1.0.

The alkylating agent used in the quaternization reaction of the compound represented by the formula (1-5) includes dialkylsulfate (1 to 3 carbon atoms in the alkyl group) or an alkyl halide (1 to 3 carbon atoms in the alkyl group).

The intended compound can be synthesized by quaternization reaction with an alkylating agent in the presence of a solvent (for example, ethanol), but is preferably synthesized in the absence of a solvent, from the viewpoint of the smell of the synthesized product, storage stability, and maintenance of transparency and/or the viewpoint of preventing formation of impurities.

<Component (c1)>

The component (c1) in the present invention is at least one compound selected from water and solvents having a C log P of 2 or less. As used herein, log P is a factor indicating the affinity of an organic compound to water and 1-octanol, and is generally expressed in the form of a logarithmic value of the ratio of the equilibrium concentrations of a compound in each solvent, namely, log P to the base 10. The value of each log P of many compounds has been reported, and many values are reported in the database available from Daylight Chemical Information Systems, Inc. (Daylight CIS) and so on, and these documents may be adopted as references. In the present invention, a value calculated with a program "C LOG P" available from Daylight CIS is used. This program also outputs the value of "calculated log P (C log P)" calculated by Fragment Approach of Hansch, Leo when there is an actual value of log P. Because this value of C log P is an estimate which is most popular and reliable at present, a value of C log P calculated using the program C LOG P v4.01 is used in the present invention.

As the component (c1) in the present invention, the solvent having a C log P value of 2.0 or less is for example at least one member selected from the group consisting of 2,2,4-trimethyl-1,3-pentanediol, 2,2-dimethyl-1,3-propanediol, 1,6-hexanediol, 1,4-cyclohexanedimethanol, 2-methyl-2,4-pentanediol, a polyoxyethylene monobutyl ether to which 1 to 3 moles on average of oxyethylene have been added, a polyoxypropylene monobutyl ether to which 1 to 3 moles on average of oxypropylene have been added, a polyoxypropylene monopropyl ether to which 1 to 3 moles on average of oxypropylene have been added, a polyoxyethylene monophenyl ether to which 1 to 4 moles on average of oxyethylene have been added, alcohols and/or glycols having 1 to 3 carbon atoms, polyhydric alcohols having 2 to 6 carbon atoms, and water. Preferably the component (c1) in the present invention is at least one compound selected from water and the solvent having C log P value of 1.5 or less.

In one embodiment, it is preferable from the viewpoint of enhancing a soil release effect that the component (c1) in the present invention is a polyoxyethylene monophenyl ether to which 1 to 4 moles on average of oxyethylene have been added, 2-methyl-2,4-pentanediol, ethanol, isopropanol, ethylene glycol, glycerin, dipropylene glycol, sorbitol, or water, and the component (c1) is more preferably is a polyoxyethylene monophenyl ether to which 1 to 4 moles on average of oxyethylene have been added, ethanol, ethylene glycol, glycerin, or water.

The component (c1) in the present invention is preferably a mixture of water and another solvent, from the viewpoint of further enhancing a soil release effect, and the mixing ratio of water/solvent having a C log P value of 2.0 or less is 1000/1 to 1/1, preferably 200/1 to 20/1, in terms of mass ratio.

<Other Component>

From the viewpoint of improving storage stability, it is preferable that the liquid softener composition of the present invention further contains a nonionic surfactant (referred to hereinafter as component (d1)).

The component (d1) is preferably a polyoxyethylene alkyl ether having a C8 to C20 alkyl or alkenyl group, particularly preferably a nonionic surfactant represented by the following formula (1-7):

$$R^{31}\text{-E-}((R^{32}O)_d\text{—}R^{33}) \quad (1\text{-}7)$$

wherein $R^{31}$ represents an alkyl or alkenyl group having 8 to 18 carbon atoms, preferably 8 to 16 carbon atoms; $R^{32}$ represents an alkylene group having 2 or 3 carbon atoms, preferably an ethylene group; $R^{33}$ represents an alkyl group having 1 to 3 carbon atoms or a hydrogen atom; d is a number of 2 to 100, preferably 4 to 80, more preferably 5 to 60, even more preferably 6 to 50; and E is —O—, —COO—, —CON< or —N< provided that when E is —O— or —COO—, e is 1, and when E is —CON< or —N<, e is 2.

Specific examples of the compound represented by the formula (1-7) include those compounds represented by the following formulae (1-7-1) to (1-7-4):

$$R^{31}\text{—O—}(C_2H_4O)_f\text{—H} \quad (1\text{-}7\text{-}1)$$

wherein $R^{31}$ has the same meaning as defined above, and f is a number of 2 to 100, preferably 10 to 50.

$$R^{31}\text{—O—}(C_2H_4O)_g\text{—}(C_3H_6O)_h\text{—H} \quad (1\text{-}7\text{-}2)$$

wherein $R^{31}$ has the same meaning as defined above; g and h independently represent a number of 2 to 100, preferably 5 to 20; and $(C_2H_4O)$ and $(C_3H_6O)$ may be in a random or block adduct.

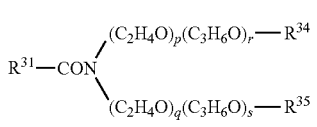

(1-7-3)

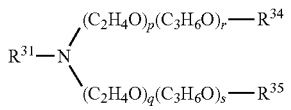

(1-7-4)

wherein $R^{31}$ has the same meaning as defined above; p, q, r and independently represent a number of 0 to 40; p+q+r+s is a number of 5 to 100, preferably 5 to 60; $(C_2H_4O)$ and $(C_3H_6O)$ may be in a random or block adduct; and $R^{34}$ and $R^{35}$ independently represent a hydrogen atom or an alkyl group having 1 to 3 carbon atoms.

From the viewpoint of improving storage stability, the liquid softener composition of the present invention further contains a metal capturing agent (referred to hereinafter as component (e1). Specific examples of the component (e1) include the following compounds:

(1) Phosphonic acids such as ethane-1,1-diphosphonic acid, ethane-1,1,2-triphosphonic acid, ethane-1-hydroxy-1,1-diphosphonic acid, ethanehydroxy-1,1,2-triphosphonic acid, ethane-1,2-dicarboxy-1,2-diphosphonic acid, and methanehydroxyphosphonic acid, or salts thereof (preferably alkali metal salts or alkanolamine salts).

(2) Aminopolyacetic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid, dienkolic acid, alkylglycine-N,N-diacetic acid, aspartic acid-N,N-diacetic acid, serine-N,N-diacetic acid, glutamic acid diacetic acid and ethylenediaminesuccinic acid or salts thereof (preferably alkali metal salts or alkanolamine salts).

Among them, the component (e1) is preferably ethane-1-hydroxy-1,1-diphosphonic acid and/or ethylenediaminetetraacetic acid, from the viewpoint of improving storage stability.

The liquid softener composition of the present invention can further contain an inorganic salt or a water-soluble organic salt (referred to hereinafter as component (f1)). From the viewpoint of storage stability, the inorganic salt is preferably sodium sulfate, sodium chloride, calcium chloride, magnesium chloride or the like, and the organic salt is preferably sodium benzoate, sodium p-toluenesulfonate, or the like. However, the liquid softener composition of the present invention may, besides the inorganic salts, contain sodium salts, potassium salts etc. contained in surfactants such as fatty acid salts.

The liquid softener composition of the present invention may contain a saturated or unsaturated fatty acid having 8 to 22 carbon atoms and/or an ester compound (component (g1)) of a saturated or unsaturated fatty acid having 8 to 22 carbon atoms and a polyhydric alcohol for improvement of storage stability. In this case, it is preferred to pay notice to the kind and content of the ester compound to obtain transparent appearance. Examples of the ester compound which may be contained include triglycerides, diglycerides, monoglycerides, mono-, di- or tri-esters of pentaerythritol and sorbitan esters. As other components in the present invention, a perfume (component (h1)) and a dye (component (i1)) can be appropriately contained depending on preference.

An inorganic acid such as hydrochloric acid or sulfuric acid or an organic acid such as citric acid, lactic acid, glycolic acid or p-toluenesulfonic acid can be incorporated as a pH regulating agent.

<Liquid Softener Composition>

The content of the component (a1) in the liquid softener composition of the present invention is 0.1 to 5.0% by mass, preferably 0.5 to 5% by mass, more preferably 1.0 to 5.0% by mass and even more preferably 1.0 to 3.0% by mass. The content of the component (b1) is 4 to 25% by mass, preferably 10 to 25% by mass. The content of the component (c1) is 95 to 40% by mass, preferably 95 to 50% by mass and more preferably 90 to 60% by mass. The content of the component (d1) is 0 to 10% by mass, preferably 0.1 to 8% by mass and more preferably 0.1 to 6% by mass. The content of the component (e1) is 0 to 1% by mass, preferably 0.001 to 1% by mass and more preferably 0.01 to 0.5% by mass. The content of the component (f1) is 0 to 1% by mass, preferably 0.001 to 1% by mass. The content of the component (g1) is 0 to 5% by mass, preferably 0.1 to 5% by mass and more preferably 0.1 to 3% by mass. The content of the component (h1) is 0 to 3% by mass, preferably 0.01 to 2% by mass and more preferably 0.1 to 2% by mass. The content of the component (i1) is 0.1 to 500 mg/kg, preferably 0.1 to 100 mg/kg.

The pH of the liquid softener composition is 2 to 5, preferably 2 to 4.5, at 20° C.

<Method of Treating Fibers>

The liquid softener composition of the present invention exhibits not only softening performance by treating fibers in an aqueous solution, but also a soil releasing effect by adsorbing the component (a1) onto fibers in a fiber product, then washing the fiber product in water after use by wearing etc., and desorbing, together with the component (a1), soil which was adsorbed into the fiber product.

In the present invention, first adsorption of the component (a1) onto fibers is conducted preferably in an aqueous solution adjusted to pH 2 to 9, from the viewpoint of adsorption onto fibers. In washing conducted after use by wearing etc., the effect can be obtained irrespective of pH, but washing with a washing solution adjusted to pH 9 to 13 is advantageous to releasability of the component (a1) from fibers and is preferable from the viewpoint of soil releasability.

In washing conducted after treatment of fiber products with the product of the present invention, it is more preferable to use a detergent. The detergent may contain additives incorporated generally into detergents, such as arbitrary components such as surfactants, hardness-component scavengers, perfumes, enzymes, alkalis, and bleaching agents.

The soil release agent of the present invention can confer an excellent soil release effect by utilizing the change, by pH, in properties of a primary to tertiary amino group. When the component (a1) having a quaternary ammonium group in place of a primary to tertiary amino group is used, there is no change in the properties by pH, and thus the excellent soil release effect as in the present invention cannot be conferred.

In the liquid softener composition of the present invention, the components (a1) and (b1) are used in a total amount of preferably 0.1 to 10 g, more preferably 0.1 to 7 g and even more preferably 0.3 to 5 g, per kg of fibers.

Then, the composition (2) of the present invention will be described.

Specific examples of the monomer units (A), (B) and (C) in the component (a2) are the same as in the component (a1).

However, the compound represented by the formula (1-1) may be an acid salt thereof or a quaternary salt thereof. The acid salt includes, for example, neutralized salts of inorganic salts such as primary, secondary and tertiary amine hydrochlorides and sulfates, and neutralized salts of various organic acid salts, and the quaternary salt includes a halogenated alkyl salt having 1 to 3 carbon atoms, and an alkyl sulfate having 1 to 3 carbon atoms. Examples of the quaternary salt include N,N,N-trimethyl-N-(2-methacryloyloxyethyl)ammonium chloride, N,N-dimethyl-N-ethyl-N-(2-methacryloyloxyethyl)ammonium ethyl sulfate, and diallyldimethylammonium chloride. These compounds are marketed under trade names such as QDM and MOEDES from MRC Unitec Co., Ltd.

The amount of monomer (C) copolymerized in (a2) is 80% by weight or less, preferably 50% by weight or less, more preferably 30% by weight or less, based on the total amount of the monomers.

The component (a2) contains the monomer unit (A) and monomer unit (B) in an (A)/(B) molar ratio of 20/80 to 99/1, more preferably 50/50 to 95/5, even more preferably 70/30 to 95/5, from the viewpoint of maintenance of transparency and softening effect.

The weight-average molecular weight (Mw) of the component (a2) is preferably 2,000 to 200,000, more preferably 3,000 to 150,000, even more preferably 5,000 to 100,000. The ratio of Mw to Mn (Mw/Mn) is preferably 1.0 to 40, more preferably 1.5 to 35.

The Mw, Mn, and Mw/Mn of the component (a2) of the present invention, similar to (a1), use values determined by GPC.

When (a2) is considered relatively hydrophilic because of a high proportion of the monomer unit (A) in the polymer to be measured, its molecular weight is calculated as a polyethylene glycol-equivalent molecular weight with 2 GPC columns for polar solvent "α-M" (manufactured by Tosoh Corporation) connected in series by using, as a solvent, 50 mmol/L LiBr solution prepared in a mixed solvent of (1% acetic acid/ethanol):water=3:7 (mass ratio) (Measurement Method A). On the other hand, when the polymer is considered relatively hydrophobic because of a high proportion of the monomer unit (B) such as in (a'2-2) and (a'2-3) used as comparative polymers in the Examples below, its molecular weight is calculated as a polystyrene-equivalent molecular weight with 2 columns for organic solvent "K-804" (manufactured by Showa Denko K.K.) connected in series by using 1 mmol/L Farmin DM20 (manufactured by Kao Corporation) solution in $CHCl_3$ (Measurement Method B).

<Component (b2)>

The component (b2) is at least one compound selected from compounds represented by the formulae (1-4) and (1-5). When a plurality of compounds are used as the component (b2), it is possible to use, for example, a mixture (referred to hereinafter as (b21)) containing 3 kinds of compounds, that is, a compound (referred to hereinafter as compound (b21-1)) represented by the formula (1-4) wherein $R^{24}$ is an alkyl group having 1 to 3 carbon atoms, a compound (referred to hereinafter as compound (b21-2)) represented by the formula (1-4) wherein $R^{24}$ is a hydrogen atom, and a compound (referred to hereinafter as compound (b21-3)) represented by the formula (1-5).

In the formulae (1-4) and (1-5), $R^{21}$, $R^{22}$, $R^{23}$, and $R^{24}$ have the same meanings as defined above. That is, the groups represented by $R^{21}$, $R^{22}$ and $R^{23}$ in the formulae (1-4) and (1-5) are any of the following groups:

(i) a saturated hydrocarbon group having 14 to 26 carbon atoms in total which is interrupted by an ester group and/or an amide group (referred to hereinafter as group (i)), (ii) an unsaturated hydrocarbon group having 14 to 26 carbon atoms in total which is interrupted by an ester group and/or an amide group (referred to hereinafter as group (ii)), (iii) a hydroxyalkyl group having 1 to 3 carbon atoms (referred to hereinafter as group (iii)), and (iv) an alkyl group having 1 to 3 carbon atoms (referred to hereinafter as group (iv)), provided that at least one of $R^{21}$, $R^{22}$ and $R^{23}$ is a group selected from the groups (i) and (ii).

From the viewpoint of maintenance of transparency and softening effect, each of $R^{21}$, $R^{22}$ and $R^{23}$ is preferably a group which is interrupted by an ester group.

From the viewpoint of obtaining a transparent appearance, it is established that, in $R^{21}$, $R^{22}$ and $R^{23}$, the molar ratio of the saturated hydrocarbon group having 14 to 26 carbon atoms in total which is interrupted by an ester group (group (i)) to the total of the saturated hydrocarbon group having 14 to 26 carbon atoms in total which is interrupted by an ester group (group (i)) and the unsaturated hydrocarbon group having 14 to 26 carbon atoms in total which is interrupted by an ester group (group (ii)), that is, the group (i)/(the group (i)+the group (ii))×100, is preferably 12 mol % or less, more preferably 10 mol % or less, even more preferably 7 mol % or less, even more preferably 5 mol % or less, and even more preferably 3 mol % or less.

From the viewpoint of maintaining storage stability, it is established in (b2) that, in $R^{21}$, $R^{22}$ and $R^{23}$, the molar ratio of an unsaturated hydrocarbon group having 1 double bond and having 14 to 26 carbon atoms in total which is interrupted by an ester group (referred to hereinafter as group (ii-1)) to the total of the group (i) and the group (ii), that is, the group (ii-1)/(the group (i)+the group (ii))×100, is preferably 70 mol % or more, more preferably 75 mol % or more, and even more preferably 80 mol % or more.

From the viewpoint of maintaining storage stability, it is established that, in $R^{21}$, $R^{22}$ and $R^{23}$, the molar ratio of an unsaturated hydrocarbon group having 2 or more double bonds and having 14 to 26 carbon atoms in total which is interrupted by an ester group (referred to hereinafter as group (ii-2)) to the total of the group (i) and the group (ii), that is, the group (ii-2)/(the group (i)+the group (ii))×100, is preferably 15 mol % or less, more preferably 10 mol % or less, and even more preferably 8 mol % or less.

In the formula (1-4), the anionic group represented by $X^-$ is the same as in (b1).

As the component (b2) in the present invention, the compound represented by the formula (1-4) can be produced by quaternization reaction of the compound represented by the formula (1-5) with an alkylating agent. The compound represented by the formula (1-5) can be produced by selecting a composition of a hydrocarbon group in the fatty acid or fatty acid lower alkyl (number of carbon atoms in the alkyl group: 1 to 3) ester such that $R^{21}$, $R^{22}$ and $R^{23}$ have a preferable composition as described above, followed by dehydration esterification reaction or ester exchange reaction of a specific number of moles of a starting fatty acid or fatty acid lower alkyl (number of carbon atoms in the alkyl group: 1 to 3) ester having such a composition, with the corresponding alkanolamine.

The alkanolamine includes, but is not limited to, dialkyl monoalkanolamine (preferably dimethyl monoethanolamine or dimethyl monopropanolamine), monoalkyl dialkanolamine (preferably methyl diethanolamine or methyl dipropanolamine), and trialkanolamine (preferably triethanolamine or tripropanolamine). The alkanolamine is particularly preferably trialkanolamine.

The fatty acid or fatty acid lower alkyl ester can be obtained in the same manner as in (b2).

In the esterification reaction or esterification exchange reaction in (b2), however, the molar ratio of a fatty acid or a fatty acid lower alkyl ester to a hydroxyl group of an alkanolamine is preferably 0.3:1.0 to 1.2:1.0, more preferably 0.5:1.0 to 1.0:1.0.

In the mixture (b21), the mass ratio of the content (I) of the compound (b21-1) to the total content (II) of the compounds (b21-2) and (b21-3), that is, (I)/(II) is preferably 99/1 to 80/20, more preferably 95/5 to 80/20 and even more preferably 95/5 to 85/15.

When the compound (referred to hereinafter as compound (b22)) of the formula (1-5) wherein $R^{21}$ represents a hydrocarbon group having 14 to 26 carbon atoms in total which is interrupted by an ester group and/or an amide group, and $R^{22}$ and $R^{23}$ independently represent a hydroxyalkyl group having 1 to 3 carbon atoms or an alkyl group having 1 to 3 carbon atoms is used, the group represented by $R^{21}$ in the formula (1-5) is any of the following groups:

(A) a saturated hydrocarbon group having 14 to 26 carbon atoms in total which is interrupted by an ester group and/or an amide group, or (B) an unsaturated hydrocarbon group having 14 to 26 carbon atoms in total which is interrupted by an ester group and/or an amide group.

From the viewpoint of softening performance, the compound (b22) is preferably a compound wherein $R^{21}$ is a saturated hydrocarbon group having 16 to 22 carbon atoms in total which is interrupted by an amide group. $R^{21}$ may contain an alkenyl group having 16 to 22 carbon atoms in total. In this case, the content of the alkenyl group is 50 mol % or less, more preferably 25 mol % or less, even more preferably 5 mol % or less, based on all $R^{21}$s. $R^{22}$ or $R^{23}$ is preferably a methyl group or an ethyl group. The compound (b22) can be obtained by amidation reaction of the corresponding dialkylaminoalkylamine (preferably dimethylaminopropylamine) with $R^{21}$—$COOR^{25}$ wherein $R^{25}$ is a hydrogen atom or an alkyl group having 1 to 3 carbon atoms.

The mixture (b21) and the compound (b22) may be used alone or as a mixture thereof.

<Component (c2)>

The component (c2) in the present invention is an organic solvent having a log P value of −0.5 to 1.5, preferably −0.3 to 1.5. The log P is a factor indicating the affinity of an organic compound to water and 1-octanol. A 1-octanol/water distribution coefficient P is a distribution coefficient obtained when a trace amount of a compound is dissolved as a solute in a solvent of a two-liquid phase consisting of 1-octanol and water, means the ratio of the equilibrium concentrations of the compound in each solvent and is usually expressed by the form of log P which is a logarithm of the ratio to the base 10. The log P can be found because the values of log P of many compounds have been reported and many values are listed in the databases available from Daylight Chemical Information Systems, Inc. (Daylight CIS) and the like. In the case where there is no actual log P value, it is most convenient to calculate based on the program "C LOG P" available from Daylight CIS. When there is an actual value of log P, this program outputs the value of "calculated log P (C log P) calculated through the fragment approach of Hansch Leo together with the actual value. The fragment approach is based on the chemical structure of a compound, taking the number of atoms and the type of chemical bond into account (cf. A. Leo Comprehensive Medicinal Chemistry, Vol. 4, C. Hansch, P. G. Sammens, J. B Taylor and C. A. Ramsden, Eds., p. 295, Pergamon Press, 1990). Because this value of C log P is most common and reliable estimated value, it may be used in place of actual value of log P in the selection of a compound. In the present invention, in the case where there is an actual value of log p, it is used whereas in the case where there is no actual value of log P, the value of C log P calculated based on the program C LOG P v4.01 is used.

As component (c2) in the present invention, the organic solvent having a log P value of −0.5 to 1.5 is for example at least one alcohol-based organic solvent selected from the group consisting of 2,2,4-trimethyl-1,3-pentanediol, 2,2-dimethyl-1,3-propanediol, 1,6-hexanediol, 1,4-cyclohexanedimethanol, 2-methyl-2,4-pentanediol, a polyoxyethylene monobutyl ether to which 1 to 3 moles on average of oxyethylene have been added, a polyoxypropylene monobutyl ether to which 1 to 3 moles on average of oxypropylene have been added, a polyoxypropylene monopropyl ether to which 1 to 3 moles on average of oxypropylene have been added, and a polyoxyethylene monophenyl ether to which 1 to 4 moles on average of oxyethylene have been added.

In one embodiment, it is preferable from the viewpoint of maintaining transparency that the component (c2) in the present invention is a polyoxyethylene monophenyl ether to which 1 to 4 moles on average of oxyethylene have been added or 2-methyl-2,4-pentanediol, and the component (c) is more preferably a polyoxyethylene monophenyl ether to which 1 to 4 moles on average of oxyethylene have been added.

<Other Components in the Composition (2) of the Present Invention>

The liquid softener composition of the present invention contains water. The water is preferably one from which hardness components such as calcium and magnesium and heavy metals such as iron, being present in a very small amount, have been removed. Deionized water or distilled water can be used. For the purpose of sterilizing or disinfecting water, a small amount of chlorine may be contained.

The liquid softener composition of the present invention may contain an anionic surfactant as the component (d2). As the anionic surfactant, it is possible to use an anionic surfactant having an alkyl group having 10 to 36 carbon atoms, preferably 16 to 28 carbon atoms and having a —$SO_3M$ group and/or —$OSO_3M$ group (M: counter ion).

From the viewpoint of improving storage stability, the liquid softener composition of the present invention, similar to the composition (1), preferably further contains a preferable nonionic surfactant (referred to hereinafter as component (d)).

From the viewpoint of improving storage stability, the liquid softener composition of the present invention, similar to the composition (1), preferably further contains a preferable metal capturing agent (referred to hereinafter as component (e)).

The liquid softener composition of the present invention, similar to the composition (1), can further contain an inorganic salt or a water-soluble organic salt (referred to hereinafter as component (f)).

The liquid softener composition of the present invention may further contain an organic solvent (referred to hereinafter as component (k2)) other than the component (c2). Specifically, the component (k2) is an organic solvent selected from ethanol, isopropanol, glycerin, ethylene glycol, propylene glycol, etc., among which ethanol is particularly preferable from the viewpoint of smell. For the purpose of improving storage stability, the liquid softener composition of the present invention may further be compounded with an ester compound between a saturated or unsaturated fatty acid having 8 to 22 carbon atoms and a polyhydric alcohol. In this case, it is preferred to pay notice to the kind and content of the ester compound to obtain transparent appearance. Examples of the ester compound which may be incorporated include triglycerides, diglycerides, monoglycerides, mono-, di- or trimesters of pentaerythritol and sorbitan esters. As other components in the present invention, perfumes and dyes can be appropriately contained depending on preference.

Then, the composition (3) of the present invention will be described.

<Component (a3)>

The component (a3) is a polymer compound wherein a structural unit derived from the compound represented by the formula (1-1) or derived from an acid salt or quaternary salt monomer thereof is contained in an upper limit of 100 mol % or less and in a lower limit of preferably 60 mol % or more, more preferably 70 mol % or more, even more preferably 80 mol % or more, even more preferably 90 mol % or more and even more preferably 95 mol % or more. Among the compounds represented by the formula (1-1), the compounds of the formula (1-1) wherein A represents —COO—$R^6$— include N,N-dimethylaminoethyl acrylate, N,N-dimethylaminomethyl acrylate, N,N-dimethylaminobutyl acrylate, N,N-dimethylaminopropyl acrylate, N,N-dimethylaminoethyl methacrylate, N,N-dimethylaminomethyl methacrylate, N,N-dimethylaminobutyl methacrylate, N,N-dimethylaminopropyl methacrylate, N,N-diethylaminoethyl acrylate, N,N-diethylaminomethyl acrylate, N,N-diethylaminobutyl acrylate, N,N-diethylaminopropyl acrylate, N,N-diethylaminoethyl methacrylate, N,N-diethylaminomethyl methacrylate, N,N-diethylaminobutyl methacrylate, and N,N-diethylaminopropyl methacrylate.

Among the compounds represented by the formula (1-1), the compounds of the formula (1-1) wherein A represents —$CONR^7$—$R^8$— include N,N-dimethylaminopropyl acrylic acid (or methacrylic acid) amide, N,N-dimethylaminomethyl acrylic acid (or methacrylic acid) amide, N,N-dimethylaminoethyl acrylic acid (or methacrylic acid) amide, and N,N-dimethylaminobutyl acrylic acid (or methacrylic acid) amide.

When X in the formula (1-1) is —$CH_2$—, $R^4$ is the group represented by the formula (1-2). Such compounds include diallylamine, and diallylmethylamine.

As the compound represented by the formula (1-1), its acid salt or quaternary salt can be used. The acid salt includes, for example, neutralized salts of inorganic salts such as primary, secondary and tertiary amine hydrochlorides and sulfates, and neutralized salts of various organic acid salts, and the quaternary salt includes a halogenated alkyl salt having 1 to 3 carbon atoms, and an alkyl sulfate having 1 to 3 carbon atoms. Examples of the quaternary salt include N,N,N-trimethyl-N-(2-methacryloyloxyethyl)ammonium chloride, N,N-dimethyl-N-ethyl-N-(2-methacryloyloxyethyl)ammonium ethyl sulfate, and diallyldimethylammonium chloride. These compounds are marketed under trade names such as QDM and MOEDES from MRC Unitec Co., Ltd. From the viewpoint of maintenance of transparency and softening effect, the compound (amine compound) represented by the formula (1-1) is preferable.

The component (a3) may have structural units derived from copolymerizable unsaturated bond-containing monomers, as structural units derived from monomers other than structural units derived from the monomers represented by the formula (1-1), in such a range that the effect of the present invention is not impaired. Examples of such monomers include vinyl alcohol; (meth)acrylates or (meth)acrylamides having a C1 to C22 hydroxyalkyl group, such as hydroxyethyl (meth)acrylate and hydroxypropyl(meth)acrylamide; (meth) acrylates having a polyalkylene (the number of carbon atoms in the alkylene group, 1 to 8; linear or branched chain) oxide chain, such as polyethyleneglycol(meth)acrylate, methoxypolyethyleneglycol(meth)acrylate, lauroxypolyethyleneglycol(meth)acrylate (polymerization degree of ethylene glycol: 1 to 100), polypropyleneglycol(meth)acrylate (polymerization degree of propylene glycol: 1 to 50), and polybutyleneglycol(meth)acrylate (polymerization degree of butylene glycol: 1 to 50); polyhydric alcohol(meth)acrylates such as glycerin(meth)acrylate; diacetone(meth)acrylamide; N-vinyl cyclic amides such as N-vinyl pyrrolidone; N-(meth)acryloyl morpholine; vinyl chloride; acrylonitrile; vinyl compounds having a carboxyl group, such as (meth)acrylic acid, maleic acid, itaconic acid, and styrenecarboxylic acid; and vinyl compounds having a sulfonic acid group, such as 2-acrylamide-2-methylpropanesulfonic acid and styrenesulfonic acid. The amount of these monomers copolymerized is 40 mol % or less, preferably 30 mol % or less, more preferably 20 mol % or less, even more preferably 10 mol % or less, and even more preferably 5 mol % or less, based on the total amount of the monomers. The component (a3) in the present invention is even more preferably a polymer compound consisting of a structural unit derived from the compound represented by the formula (1-1) or derived from an acid salt or quaternary salt monomer thereof.

The weight-average molecular weight (Mw) of the component (a3) is preferably 2,000 to 1,000,000, more preferably 3,000 to 500,000 and even more preferably 5,000 to 200,000. The ratio of Mw to Mn (Mw/Mn) is preferably 1.0 to 40, more preferably 1.5 to 35.

The Mw and Mn of the component (a3) used in the present invention are values determined by gel permeation chromatography (GPC). The molecular weight is calculated as a polyethylene glycol-equivalent molecular weight with 2 GPC columns for polar solvent "α-M" (manufactured by Tosoh Corporation) connected in series by using, as a solvent, 50 mmol/L LiBr solution prepared in a mixed solvent of (1% acetic acid/ethanol):water=3:7 (mass ratio).

<Component (b3)>

The component (b) is at least one compound selected from compounds represented by the formulae (1-4) and (1-5). When a plurality of compounds are used as the component (b3), it is possible to use, for example, a mixture (referred to hereinafter as (b31)) containing 3 kinds of compounds, that is, a compound (referred to hereinafter as compound (b31-1)) represented by the formula (1-4) wherein $R^{24}$ is an alkyl group having 1 to 3 carbon atoms, a compound (referred to hereinafter as compound (b31-2)) represented by the formula (1-4) wherein $R^{24}$ is a hydrogen atom, and a compound (referred to hereinafter as compound (b31-3)) represented by the formula (1-5) wherein two or more of $R^{21}$, $R^{22}$ and $R^{23}$ each represent a hydrocarbon group having 14 to 26 carbon atoms in total which is interrupted by an ester group and/or an amide group.

The meanings of $R^{21}$, $R^{22}$, $R^{23}$, and $R^{24}$ in the formulae (1-4) and (1-5), preferable examples thereof, anionic groups represented by $X^-$, methods for producing them, and compound (b22) are the same as described in the component (b2).

The explanation of the component (c3) is the same as in the component (c2).

<Component (d3)>

The compound represented by the formula (3-5) is one kind of nonionic surfactant. Specific compounds represented by the formula (3-5) include compounds represented by the following formulae (3-5-1) to (3-5-4):

$$R^{31}—O—(C_2H_4O)_g—H \quad (3\text{-}5\text{-}1)$$

wherein $R^{31}$ has the same meaning as defined above, and g is a number of 2 to 100, preferably 10 to 40.

$$R^{31}—O—(C_2H_4O)_h—(C_3H_6O)_i—H \quad (3\text{-}5\text{-}2)$$

wherein $R^{31}$ has the same meaning as defined above; h and i independently represent a number of 0 to 100, preferably 5 to 20; h+i is a number of 2 to 100, preferably 10 to 40; and $(C_2H_4O)$ and $(C_3H_6O)$ may be in a random or block adduct.

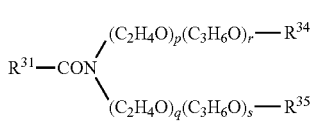

(3-5-3)

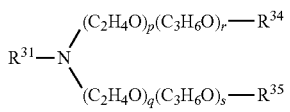

(3-5-4)

wherein $R^{31}$ has the same meaning as defined above; p, q, r and independently represent a number of 0 to 50, p+r and q+s independently represent a number of 2 to 100, preferably 5 to 20, and p+q+r+s is a number of 4 to 100, preferably to 40; $(C_2H_4O)$ and $(C_3H_6O)$ may be in a random or block adduct;

and $R^{34}$ and $R^{35}$ independently represent a hydrogen atom or an alkyl group having 1 to 3 carbon atoms.

The compound represented by the formula (3-6) is one kind of cationic surfactant. Specific compounds represented by the formula (3-6) include compounds represented by the following formulae (3-6-1) to (3-6-3):

(3-6-1)

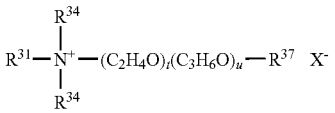

(3-6-2)

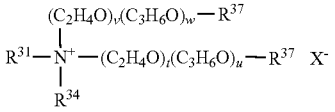

(3-6-3)

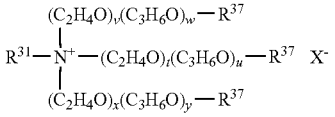

wherein $R^{31}$ and $R^{34}$ have the same meanings as defined above; t, u, v, w, x and y independently represent a number of 0 to 50, t+u, v+w, and x+y independently represent a number of 2 to 100, preferably 5 to 20, and t+u+v+w is a number of to 100, preferably 10 to 40, and t+u+v+w+x+y is a number of 6 to 100, preferably 10 to 40; $(C_2H_4O)$ and $(C_3H_6O)$ may be in a random or block adduct; and $R^{37}$s independently represent a hydrogen atom or an alkyl group having 1 to 3 carbon atoms.

The compounds represented by the formulae (3-5) and (3-6) may be used alone or as a mixture thereof.

<Liquid Softener Composition (3)>

The liquid softener composition (3) of the present invention is a composition wherein the content of the component (a3) is 0.01 to 5.0% by mass, preferably 0.05 to 4.0% by mass, the content of the component (b3) is 5 to 30% by mass, preferably 8 to 20% by mass, the content of the component (c3) is 5 to 30% by mass, preferably 8 to 20% by mass, and the content of the component (d3) is 5 to 20% by mass, preferably 5 to 15% by mass, even more preferably 5 to 10% by mass.

The liquid softener composition of the present invention contains water. The water is preferably one from which hardness components such as calcium and magnesium and heavy metals such as iron, being present in a very small amount, have been removed, and deionized water or distilled water can be used. For the purpose of sterilizing or disinfecting water, a small amount of chlorine may be contained.

When the compound (b22) is used as the component (b3), the liquid softener composition (3) of the present invention preferably contains an anionic surfactant as the component (d3) with the intention of improving softening performance. As the anionic surfactant, it is possible to use an anionic surfactant having an alkyl group having 10 to 36 carbon atoms, preferably 16 to 28 carbon atoms and having a —$SO_3M$ group and/or —$OSO_3M$ group (M: counter ion).

From the viewpoint of improving storage stability, it is preferable that the liquid softener composition (3) of the present invention, similar to the composition (1), further contains a preferable metal capturing agent (referred to hereinafter as component (e)).

The liquid softener composition (3) of the present invention, similar to the composition (1), can further contain an inorganic salt or a water-soluble organic salt as component (f).

The liquid softener composition (3) of the present invention, similar to the composition (2), can further contain an organic solvent as component k2.

EXAMPLES

The present invention is described in detail with reference to the Examples. The Examples are merely illustrative of the present invention and are not intended to limit the present invention.

Hereinafter, synthesis examples of the component (a1) and comparative polymers will be described.

Synthesis Example 1-1

35.60 g of dimethylaminoethyl methacrylate, 14.40 g of lauryl methacrylate, and 180.0 g of ethanol were uniformly mixed, then charged into a 300-mL glass separable flask, and stirred for a predetermined time in a nitrogen atmosphere. A solution prepared by dissolving 1.41 g of 2,2'-azobis(2,4-dimethylvaleronitrile) (V-65, manufactured by Wako Pure Chemical Industries, Ltd.) in 20.0 g of ethanol was added thereto and heated to about 60° C. The mixture was polymerized and aged by keeping it at about 60 to 70° C. for 8 hours in total. The reaction solution was diluted with 100.0 g of ethanol and then cooled to room temperature. The reaction solution was added dropwise to 4000.0 g of deionized water and purified by re-precipitation, and the precipitates were dried to give polymer 1. The weight-average molecular weight of polymer 1 (polyethylene oxide-equivalent molecular weight in water/ethanol=7/3) was 11000. The composition of polymer 1 analyzed by $^1$H-NMR was the same as in the charged monomer composition.

Synthesis Example 1-2

Polymer 2 was obtained in the same manner as in Synthesis Example 1-1 except that the amount of dimethylaminoethyl methacrylate was changed to 36.03 g, 13.97 g of butyl methacrylate was used in place of lauryl methacrylate, the amount of ethanol initially added was changed to 111.7 g, and the amounts of 2,2'-azobis(2,4-dimethylvaleronitrile) and ethanol added thereafter were changed to 0.41 g and 5.0 g respectively. The weight-average molecular weight of polymer 2 (polyethylene oxide-equivalent molecular weight in water/ethanol=7/3) was 47000. The composition of polymer 2 analyzed by $^1$H-NMR was the same as in the charged monomer composition.

Synthesis Example 1-3

Polymer 3 was obtained in the same manner as in Synthesis Example 1-1 except that the amount of dimethylaminoethyl methacrylate was changed to 36.85 g, 13.15 g of styrene was used in place of lauryl methacrylate, the amount of ethanol initially added was changed to 111.7 g, and the amounts of 2,2'-azobis(2,4-dimethylvaleronitrile) and ethanol added thereafter were changed to 0.45 g and 5.0 g respectively. The weight-average molecular weight of polymer 3 (polystyrene-equivalent molecular weight in dimethylformamide) was 9200. The composition of polymer 3 analyzed by $^1$H-NMR was the same as in the charged monomer composition.

Synthesis Example 1-4

Polymer 4 was obtained in the same manner as in Synthesis Example 1-1 except that 37.22 g of diethylaminoethyl methacrylate was used in place of dimethylaminoethyl methacrylate, the amount of lauryl methacrylate added was changed to 12.78 g, the amount of ethanol initially added was changed to 111.7 g, and the amounts of 2,2'-azobis(2,4-dimethylvaleronitrile) and ethanol added thereafter were changed to 0.31 g and 5.0 g respectively. The weight-average molecular weight of polymer 4 (polyethylene oxide-equivalent molecular weight in water/ethanol=7/3) was 28000. The composition of polymer 4 analyzed by $^{1}$H-NMR was the same as in the charged monomer composition.

Synthesis Example 1-5

Polymer 5 was obtained in the same manner as in Synthesis Example 1-4 except that the amount of ethanol initially added was changed to 160.0 g and the amounts of 2,2'-azobis(2,4-dimethylvaleronitrile) and ethanol added thereafter were changed to 2.49 g and 40.0 g respectively. The weight-average molecular weight of polymer 5 (polyethylene oxide-equivalent molecular weight in water/ethanol=7/3) was 9500. The composition of polymer 5 analyzed by $^{1}$H-NMR was the same as in the charged monomer composition.

Synthesis Example 1-6

10.00 g of dimethylaminoethyl methacrylate, 6.67 g of lauryl acrylate, 33.33 g of methoxypolyethyleneglycol methacrylate (average polymerization degree of ethylene glycol, 23; NK Ester M-230G, manufactured by Shin-Nakamura Chemical Co., Ltd.), 33.3 g of 2-butanone, and 0.80 g of 2,2'-azobis(2,4-dimethylvaleronitrile) were uniformly mixed, then charged into a 300-mL glass separable flask, and stirred for a predetermined time in a nitrogen atmosphere. The solution was heated to about 60° C. and polymerized and aged by keeping it at about 60° C. for 7 hours. The reaction solution was diluted with 200.0 g of 2-butanone and then cooled to room temperature. The reaction solution was added dropwise to 4000.0 g of n-hexane and purified by re-precipitation, and the precipitates were dried to give polymer 6. The weight-average molecular weight of polymer 6 (polyethylene oxide-equivalent molecular weight in water/ethanol=7/3) was 52000. The composition of polymer 6 analyzed by $^{1}$H-NMR was the same as in the charged monomer composition.

Synthesis Example 1-7

Comparative Example 15.00 g of lauryl methacrylate, 35.00 g of methoxypolyethyleneglycol methacrylate (average polymerization degree of ethylene glycol, 9; NK Ester M-90G, manufactured by Shin-Nakamura Chemical Co., Ltd.), 50.0 g of 2-butanone, and 0.50 g of 2,2'-azobis(2,4-dimethylvaleronitrile) were uniformly mixed, then charged into a 300-mL glass separable flask, and stirred for a predetermined time in a nitrogen atmosphere. The solution was heated to about 65° C. and polymerized and aged by keeping it at about 65° C. for 6 hours. The reaction solution was dried to give polymer 7. The weight-average molecular weight of polymer 7 (polystyrene-equivalent molecular weight in chloroform) was 84000. The composition of polymer 7 analyzed by $^{1}$H-NMR was the same as in the charged monomer composition.

Synthesis Example 1-8

Comparative Example 3.35 g of acrylic acid, 1.65 g of lauryl acrylate, 3.3 g of isopropyl alcohol, and 0.025 g of 2,2'-azobis(2,4-dimethylvaleronitrile) were uniformly mixed, then charged into a 300-mL glass separable flask, and heated to about 75° C. in a nitrogen atmosphere. A solution prepared by uniformly mixing 30.15 g of acrylic acid, 14.85 g of lauryl acrylate, 29.6 g of isopropyl alcohol, and 0.225 g of 2,2'-azobis(2,4-dimethylvaleronitrile) was added dropwise over 3 hours, and the mixture was polymerized and aged by keeping it at about 75° C. for 0.5 hour. Further, a solution prepared by uniformly mixing 1.7 g of isopropyl alcohol and 0.21 g of 2,2'-azobis(2,4-dimethylvaleronitrile) was added dropwise over 1 hour, and the mixture was aged at about 70° C. for 1 hour. The reaction solution was dried to give polymer 8. The weight-average molecular weight of polymer 8 (polystyrene-equivalent molecular weight in dimethylformamide) was 28000. The composition of polymer 8 analyzed by $^{1}$H-NMR was the same as in the charged monomer composition.

Synthesis Example 1-9

Comparative Example 50.00 g of dimethylaminoethyl methacrylate and 11.04 g of deionized water were uniformly mixed and then charged into a 300-mL glass separable flask. After heating to about 50° C., 48.79 g of diethyl sulfate was added dropwise over 2 hours to it under stirring. After dropwise addition, the mixture was kept at 50° C. for 1 hour under stirring, to synthesize an aqueous solution of methacryloyloxyethyldimethylethyl ammonium ethyl sulfate (MOEDES).

Polymer 9 was obtained in the same manner as in Synthesis Example 1-1 except that 47.81 g of the aqueous solution of MOEDES prepared above was used in place of dimethylaminoethyl methacrylate, the amount of lauryl methacrylate was changed to 6.30 g, the amount of ethanol initially added was changed to 175.9 g, the amount of 2,2'-azobis(2,4-dimethylvaleronitrile) was changed to 1.64 g, and purification by re-precipitation was carried out with hexane. The weight-average molecular weight of polymer 9 (polyethylene oxide-equivalent molecular weight in water/ethanol=7/3) was 33000. The composition of polymer 9 analyzed by $^{1}$H-NMR was the same as in the charged monomer composition.

The compositions of polymers 1 to 9 synthesized in Synthesis Examples 1-1 to 1-9 are collectively shown in Table 1-1.

TABLE 1-1

| | Names of constituent monomers | | | Molar ratio of constituent monomers | | | Weight-average |
|---|---|---|---|---|---|---|---|
| | Monomer (A) | Monomer (B) | Monomer (C) | Monomer (A) | Monomer (B) | Monomer (C) | molecular weight |
| a1-1 | Dimethylaminoethyl methacrylate | Lauryl methacrylate | — | 80 | 20 | | 11000 |

TABLE 1-1-continued

| | Names of constituent monomers | | | Molar ratio of constituent monomers | | | Weight-average |
|---|---|---|---|---|---|---|---|
| | Monomer (A) | Monomer (B) | Monomer (C) | Monomer (A) | Monomer (B) | Monomer (C) | molecular weight |
| a1-2 | Dimethylaminoethyl methacrylate | Butyl methacrylate | — | 70 | 30 | | 47000 |
| a1-3 | Dimethylaminoethyl methacrylate | Stylene | — | 65 | 35 | | 9200 |
| a1-4 | Diethylaminoethyl methacrylate | Lauryl methacrylate | — | 80 | 20 | | 28000 |
| a1-5 | Diethylaminoethyl methacrylate | Lauryl methacrylate | — | 80 | 20 | | 9500 |
| a1-6 | Dimethylaminoethyl methacrylate | Lauryl methacrylate | Methoxypolyethylene glycol(23) methacrylate | 53 | 22 | 25 | 52000 |
| a1-7 | — | Lauryl methacrylate | Methoxypolyethylene glycol(23) methacrylate | | 65 | 35 | 84000 |
| a1-8 | — | Lauryl methacrylate | Acrylic acid | | 12 | 88 | 28000 |
| a1-9 | N,N-dimethyl-N-ethyl ammonium ethyl methacrylate ethyl sulfate | Lauryl methacrylate | — | 85 | 15 | | 33000 |

Hereinafter, synthesis examples of the component (b1) will be described.

Synthesis Example 1-10

Tallowate and palm oil-derived fatty acid were mixed in a mass ratio of 1/1 and then partially hydrogenated to give fatty acid (acid value, 206; iodine value, 38; the content of fatty acid having 2 unsaturated groups: 7 mol %), and the resulting fatty acid and triethanolamine were mixed in a molar ratio of 1.7/1 and subjected in a usual manner to dehydration condensation reaction. When the acid value reached 5, the reaction was terminated to give a condensate. The total amine value of this condensate was measured. In the absence of a solvent, this condensate was then subjected to quaternization reaction with dimethylsulfate in an amount of 0.95 equivalent relative to the condensate and then diluted to 90% by mass with ethanol, to give the objective compound.

This compound contains N-methyl-N,N,N-triethanol ammonium methyl sulfate as byproduct, and unreacted fatty acid. The content of the component (b1) in this compound was calculated by subtracting, from the solid content (90% by mass), the contents of the byproduct and fatty acid quantified by liquid chromatography.

Synthesis Example 1-11

Rapeseed oil-derived raw fatty acid (iodine value, 90 g $I_2$/100 g; acid value, 201 mg KOH/g) and triethanolamine were mixed in a molar ratio of 1.85/1 (fatty acid/triethanolamine) and subjected in a usual manner to dehydration condensation reaction. When the acid value reached 5, the reaction was terminated to give a condensate. Then, the total amine value of this condensate was measured. In the absence of a solvent, this condensate was then subjected in a usual manner to quaternization with dimethylsulfate in an amount of 0.95 equivalent relative to the condensate and then diluted to 90% with ethanol, to give the objective quaternary ammonium salt mixture.

This compound contains N-methyl-N,N,N-triethanol ammonium methyl sulfate as byproduct, and unreacted fatty acid. The content of the component (b1) in this compound was calculated by subtracting, from the solid content (90% by mass), the contents of the byproduct and fatty acid quantified by liquid chromatography.

Synthesis Example 1-12

A fatty acid mixture consisting of stearic acid and palmitic acid in a molar ratio of 6/4, and N-(3-alkanoylaminopropyl)-N-(2-hydroxyethyl)-N-methylamine, were mixed in a molar ratio of 1.8/1 and subjected in a usual manner to dehydration condensation. When the acid value reached 9, the reaction was terminated to give a condensate. The total amine value of this condensate was measured. This condensate was melted by heating to 70° C. To the condensate was added deionized water (65° C.) that was 9 times larger in mass than the condensate, and while 35% aqueous hydrochloric acid necessary for neutralization, calculated on the basis of the total amine value, was added dropwise to it under stirring, the compound was neutralized in water, stirred for 10 minutes and then cooled to 30° C. Then, this compound was freeze-dried to give the objective amine salt compound.

To determine the content of the component (b1) in this compound, the content of the unreacted fatty acid was calculated by measuring the acid value, and the content of the remaining component was regarded as the content of the component (b1).

Synthesis Example 1-13

Tallowate and palm oil-derived fatty acid were mixed in a mass ratio of 1/1 and then partially hydrogenated to give fatty acid (acid value, 206; iodine value, 38; the content of fatty acid having 2 unsaturated groups: 7 mol %), and the resulting fatty acid and N-methyldiethanolamine were mixed in a molar ratio of 1.9/1 and subjected in a usual manner to dehydration condensation reaction. When the acid value reached 10, the reaction was terminated to give a condensate. The total amine value of this condensate was measured. To this condensate was added 8% by mass of ethanol, and the mixture was then subjected in a usual manner to quaternization reaction with methyl chloride in an amount of 0.98 equivalent based on the condensate and then diluted to a solid content of 90% by mass with ethanol, to give the objective compound.

To determine the content of the component (b1) in this compound, the content of the unreacted fatty acid was calculated by measuring the acid value, and the content of the remaining component was regarded as the content of the component (b1).

The blended components used in the Examples are collectively shown below.

Component (a1)

(a1-1): the polymer obtained in Synthesis Example 1-1

(a1-2): the polymer obtained in Synthesis Example 1-2

(a1-3): the polymer obtained in Synthesis Example 1-3

(a1-4): the polymer obtained in Synthesis Example 1-4

(a1-5): the polymer obtained in Synthesis Example 1-5

(a1-6): the polymer obtained in Synthesis Example 1-6

Comparative Polymers (a'1-7): the polymer obtained in Synthesis Example 1-7

(a'1-8): the polymer obtained in Synthesis Example 1-8

(a'1-9): the polymer obtained in Synthesis Example 1-9

Component (b1)

(b1-1): the quaternary ammonium salt mixture obtained in Synthesis Example 1-10

(b1-2): the quaternary ammonium salt mixture obtained in Synthesis Example 1-11

(b1-3): the amine salt compound obtained in Synthesis Example 1-12

(b1-4): the quaternary ammonium salt mixture obtained in Synthesis Example 1-13

Component (c1)

(c1-1): ethanol (C log P=−0.24)

(c1-2): ethylene glycol (C log P=−1.37)

(c1-3): polyoxyethylene (average number of moles added: 3) monophenyl ether (C log P=1.32)

(c1-4): 2-methyl-2,4-pentanediol (C log P=−0.02)

(c1-5): deionized water

Other Components (d1-1): polyoxyethylene (average number of moles added: 20) monolauryl ether (e1-1): tetrasodium ethylenediaminetetraacetate (f1-1): calcium chloride (g1-1): tallowate glycerides (monoglyceride content 50%)

(g1-2): fatty acids carried over from each component (b1)

(h1-1): perfume composition (i1-1): blue color No. 1

(j1-1): an acid necessary for adjusting the pH of the composition to predetermined pH. 35% aqueous hydrochloric acid and 48% aqueous sodium hydroxide were used.

Liquid softener compositions were prepared by the following method, and their release performance and softening performance were evaluated by the following method. The results are shown in Table 1-2.

<Method of Preparing Liquid Softener Composition>

Deionized water weighting 95% of 200 g that was the finished weight of a softener composition to be prepared was introduced into a 300-mL beaker and heated to 60° C. on a water bath. While the water was stirred at 300 rpm with a turbine-type stirrer equipped with 3 stirring blades each having a length of 2 cm, a predetermined amount of component (c1) and if necessary components (d1) and (e1) were dissolved therein. Then, a necessary amount of melted component (b1) was added (component (b1-3) was added in a solid form). If component (g1) was added, it was previously mixed with component (b1) and added in a molten state. The mixture was stirred for 10 minutes as it was, and then 10% aqueous hydrochloric acid and/or 10% aqueous sodium hydroxide necessary for adjusting the mixture to pH 2.0 to 2.5 was added. Then, components (f1), (h1) and (i1) were added as necessary and stirred for 5 minutes, and then component (a1) was added and stirred for additional 5 minutes. Then, the mixture was cooled to 20° C. on a water bath at 5° C., the pH was adjusted again, and deionized water at 20° C. in an amount necessary for the finished weight was added. Thus prepared compositions in Examples 1-1 to 1-10 and Comparative Examples 1-1 and 1-7 are shown in Table 1-2. Standard compositions for softness evaluation (Examples 1-1' to 1-10' and Comparative Examples 1-1' to 1-3', 1-6' and 1-7'), wherein the component (a1) was not incorporated and so the component (b1) was incorporated in the total amount of the components (a1) and (b1) incorporated, were prepared as standard compositions for softness evaluation.

<Method of Evaluating Soil Release Effect>

(1) Treatment of Fibers 0.2 g composition in Table 1-2 was added to 500 mL of 4° DH hard water (calcium/magnesium=7/3) at 20° C. to give a treatment solution. The pH of the treatment solution was 6.5 to 7.5. 25 g of cloth pieces of 6×6 cm in size, cut from a cotton broad cloth (staining material manufactured by Tanigashira Shoten Co., Ltd.), were introduced into the treatment solution, then treated by stirring at a revolution number of 80 rpm for 5 minutes with a Tergo-to-meter, dehydrated in a dewatering bin of a dual-bath washing machine (PS-H35L manufactured by Hitachi, Ltd.) and dried naturally.

(2) Preparation of Model Sebum Stain

A model sebum stain was prepared by adding 0.01 g of a dye (Oil Orange SS manufactured by Tokyo Chemical Industry Co., Ltd.) to a sebum component mixture (oleic acid/triolein/squwalene=45/40/15 by weight (all manufactured by Wako Pure Chemical Industries, Ltd.).

(3) Preparation of Model Sebum-Stained Cloth 80 mg of the model sebum stain was dropped onto 1 cotton broad cloth (6×6 cm) treated with the composition in Table 1-2 by the method in (1) above, to prepare a stained cloth.

(4) Washing of Fibers 150 mg of a nonionic surfactant (EMULGEN 108 manufactured by Kao Corporation) and 150 mg of sodium carbonate (manufactured by Wako Pure Chemical Industries, Ltd.) were added to 1 L of 4° DH hard water (calcium/magnesium=7/3) at a temperature of 20° C. (the pH of the resulting cleaning solution=10.1), and the stained cloth prepared above was introduced into it. The cloth was washed by stirring at a revolution number of 80 rpm for 10 minutes with a Tergo-to-meter.

(5) Calculation of Detergency Ratio

The untreated cloth, the stained cloth before washing, and the stained cloth after washing were measured for their reflectance (460 nm) with a calorimetric color-difference meter (ND-300A manufactured by Nippon Denshoku Kogyo K. K.), and detergency ratio D (%) was calculated according to the following equation and used as an indicator of stain release effect.

$$D(\%)=(L_2-L_1)/(L_0-L_1))\times 100$$

wherein $L_0$ is the reflectance of the untreated cloth, $L_1$ is the reflectance of the stained cloth before washing, and $L_2$ is the reflectance of the stained cloth after washing.

TABLE 1-2

| | | Example | | | | | | | | | |
|---|---|---|---|---|---|---|---|---|---|---|---|
| | | 1-1 | 1-2 | 1-3 | 1-4 | 1-5 | 1-6 | 1-7 | 1-8 *3 | 1-9 | 1-10 |
| Component (a1) | a1-1 | 3 | | | | | | 3 | 3 | 3 | 0.8 |
| | a1-2 | | 3 | | | | | | | | |
| | a1-3 | | | 3 | | | | | | | |
| | a1-4 | | | | 3 | | | | | | |
| | a1-5 | | | | | 3 | | | | | |
| | a1-6 | | | | | | 3 | | | | |

TABLE 1-2-continued

| | | | | | | | | | | | |
|---|---|---|---|---|---|---|---|---|---|---|---|
| Component (a'1) | a'1-7 | | | | | | | | | | |
| | a'1-8 | | | | | | | | | | |
| | a'1-9 | | | | | | | | | | |
| Component (b1) | b1-1 | | | | | | | 15 | | | |
| | b1-2 | | | | | | | | 15 | | |
| | b1-3 | 15 | 15 | 15 | 15 | 15 | 15 | | | | 15 |
| | b1-4 | | | | | | | | | 15 | |
| Component (c1) | c1-1 *1 | | | | | | | 2.5 | 2.5 | 2.5 | |
| | c1-2 | | | | | | | 10 | | 10 | |
| | c1-3 | | | | | | | | 10 | | |
| | c1-4 | | | | | | | | 10 | | |
| | c1-5 | 77.2 | 77.2 | 77.2 | 77.2 | 77.2 | 77.2 | 65.1 | 55.1 | 64.4 | 79.4 |
| Others | d1-1 | 2 | 2 | 2 | 2 | 2 | 2 | 2 | 2 | 2 | 2 |
| | e1-1 | 0.01 | 0.01 | 0.01 | 0.01 | 0.01 | 0.01 | 0.01 | 0.01 | 0.01 | 0.01 |
| | f1-1 | 0.1 | 0.1 | 0.1 | 0.1 | 0.1 | 0.1 | 0.1 | 0.1 | 0.1 | 0.1 |
| | g1-1 | 1 | 1 | 1 | 1 | 1 | 1 | 1 | 1 | 1 | 1 |
| | g1-2 *2 | 0.7 | 0.7 | 0.7 | 0.7 | 0.7 | 0.7 | 0.3 | 0.3 | 1 | 0.7 |
| | h1-1 | 1 | 1 | 1 | 1 | 1 | 1 | 1 | 1 | 1 | 1 |
| | i1-1 | 0.0005 | 0.0005 | 0.0005 | 0.0005 | 0.0005 | Balance: | 0.0005 | 0.0005 | 0.0005 | 0.0005 |
| | j1-1 | Suitable amount | Suitable amount | Suitable amount | Suitable amount | Suitable amount | Suitable amount | Suitable amount | Suitable amount | Suitable amount | Suitable amount |
| pH (20° C.) | | 2.5 | 2.5 | 2.5 | 2.6 | 2.5 | 2.5 | 3.0 | 3.0 | 3.0 | 3.0 |
| detergency ratio (%) | | 58 | 50 | 52 | 52 | 58 | 49 | 57 | 57 | 57 | 49 |
| Softness | | ◎ | ○ | ○ | ○ | ◎ | ○ | ◎ | ◎ | ◎ | ○ |

| | | Comparative example | | | | | | |
|---|---|---|---|---|---|---|---|---|
| | | 1-1 | 1-2 | 1-3 | 1-4 | 1-5 *3 | 1-6 | 1-7 |
| Component (a1) | a1-1 | | | | | | 15 | 3 |
| | a1-2 | | | | | | | |
| | a1-3 | | | | | | | |
| | a1-4 | | | | | | | |
| | a1-5 | | | | | | | |
| | a1-6 | | | | | | | |
| Component (a'1) | a'1-7 | 3 | | | | | | |
| | a'1-8 | | 3 | | | | | |
| | a'1-9 | | | 3 | | | | |
| Component (b1) | b1-1 | | | | | | | |
| | b1-2 | | | | | 15 | | |
| | b1-3 | 15 | 15 | 15 | 15 | | 3 | 80 |
| | b1-4 | | | | | | | |
| Component (c1) | c1-1 *1 | | | | | 2.5 | | |
| | c1-2 | | | | | | | |
| | c1-3 | | | | | 10 | | |
| | c1-4 | | | | | 10 | | |
| | c1-5 | 77.2 | 77.2 | 77.2 | 80.2 | 58.1 | 77.8 | 11.0 |
| Others | d1-1 | 2 | 2 | 2 | 2 | 2 | 2 | 2 |
| | e1-1 | 0.01 | 0.01 | 0.01 | 0.01 | 0.01 | 0.01 | 0.01 |
| | f1-1 | 0.1 | 0.1 | 0.1 | 0.1 | 0.1 | 0.1 | 0.1 |
| | g1-1 | 1 | 1 | 1 | 1 | 1 | 1 | 1 |
| | g1-2 *2 | 0.7 | 0.7 | 0.7 | 0.7 | 0.3 | 0.1 | 1.9 |
| | h1-1 | 1 | 1 | 1 | 1 | 1 | 1 | 1 |
| | i1-1 | 0.0005 | 0.0005 | 0.0005 | 0.0005 | 0.0005 | 0.0005 | 0.0005 |
| | j1-1 | Suitable amount | Suitable amount | Suitable amount | Suitable amount | Suitable amount | Suitable amount | Suitable amount |
| pH (20° C.) | | 2.5 | 2.5 | 2.5 | 2.5 | 3.0 | 8.0 | — |
| detergency ratio (%) | | 42 | 42 | 42 | 42 | 41 | 42 | 10 |
| Softness | | X | X | ○ | — | — | X | Δ |

*1 Carry-over from the component (b1) is contained.
*2: Carry-over from the component (b1).
*3: The liquid softener compositions in Examples 1-8 and Comparative Examples 1-5 are transparent in appearance.

<Method of Evaluating Softness>

Clothes were treated in the following manner with each of fiber product treatment agents and standard compositions in Table 1-2, prepared by the preparation method shown above, were used to evaluate the softening effect of each agent under the following criteria by a panel of 10 examiners (10 males in their thirties) thereby calculating an average.

(Method of Softening Treatment)

Commercially available cotton towels (100% cotton) were washed using a commercially available weakly alkaline detergent (Attack, manufactured by Kao Corporation) (in a fully automatic washing machine NA-F60E manufactured by National, detergent concentration: 20 g/30 L, bath ratio: 17, water temperature: 20° C., washing course: standard course). This operation was conducted repeatedly 5 times, and the towels were dried under the conditions of 20° C. and 45% RH, to give towels for evaluation.

The towels for evaluation, prepared by the method described above, were subjected to softening treatment using Attack (manufactured by Kao Corporation) and each of the compositions shown in Table 1-2 or the standard compositions for softness evaluation (in a fully automatic washing machine NA-F60E manufactured by National, standard course, the set amount of water: 40 L, bath ratio: 17, water temperature: 20° C. (tap water), the amount of Attack used: 40 g, the amount of the softener used: 11 mL; Attack was introduced simultaneously with the cotton towels into a washing tub. The softener was introduced through a softener inlet provided in the washing machine).

(Evaluation Criteria of Softening Effect)

By using, as standard, the softness of the cotton towels treated with the standard composition, the softness of the cotton towels treated with each of the fiber treatment compositions shown in Table 1-2 was judged according to the following criteria by a panel of 10 examiners (10 males in their thirties) to calculate an average. The case where the average was 0.7 or more was judged to be ◎, the case where the average was 0.3 or more to less than 0.7 was judged to be ○, the case where the average was −0.3 or more to less than 0.3 was judged to be Δ and the case where the average was less than −0.3 was judged to be x. The results are shown in Table 1-2.

Point 1: Softer than the standard

Point 0: The same softness as the standard

Point −1: Harder than the standard

Hereinafter, synthesis examples of the component (a2) and comparative polymers will be described.

Synthesis Example 2-1

42.37 g of N,N-dimethylaminoethyl methacrylate (molecular weight: 157.21), 7.62 g of lauryl methacrylate (molecular weight: 254.41), and 180.0 g of ethanol were uniformly mixed, then charged into a 300-mL glass separable flask, and stirred for a predetermined time in a nitrogen atmosphere. A solution prepared by dissolving 1.41 g of 2,2'-azobis(2,4-dimethylvaleronitrile) (V-65, manufactured by Wako Pure Chemical Industries, Ltd.) in 20.0 g of ethanol was added thereto and heated to about 60° C. The mixture was polymerized and aged by keeping it at about 60 to 70° C. for 8 hours in total. The reaction solution was diluted with 100.0 g of ethanol and then cooled to room temperature. The reaction solution was added dropwise to 4000.0 g of deionized water and purified by re-precipitation, and the precipitates were dried to give polymer 1. The Mw, Mn, and Mw/Mn of polymer 1 (polyethylene oxide-equivalent molecular weight in water/ethanol=7/3) were 11000, 2800, and 3.9 respectively. The composition of polymer 1 analyzed by $^{1}$H-NMR was the same (DMAEMA/LMA=9/1 (molar ratio)) as in the charged monomer composition.

In Synthesis Example 2-2 and synthesis examples thereafter, polymers having the compositions (molar ratios) and molecular weights shown below were obtained by the same method as in Synthesis Example 2-1 except that the following monomers were used.

Synthesis Example 2-2

DMAEMA/SMA=9/1, Mw: 8700, Mn: 4300, Mw/Mn: 2.0

Synthesis Example 2-3

DMAEMA/BMA=9/1, Mw: 13200, Mn: 5300, Mw/Mn: 2.5

Synthesis Example 2-4

DMAEMA/MMA=6/4, Mw: 7800, Mn: 1200, Mw/Mn: 6.5

Synthesis Example 2-5

QDM/BMA=7/3, Mw: 114000, Mn: 3400, Mw/Mn: 34

Synthesis Example 2-6

QDM/BMA=5/5, Mw: 47000, Mn: 4200, Mw/Mn: 11

Synthesis Example 2-7

QDM/BMA=3/7, Mw: 12000, Mn: 2500, Mw/Mn: 4.8

Synthesis Example 2-8

DMAEMA/St=65/35, Mw: 9200, Mn: 5100, Mw/Mn: 1.8

Synthesis Example 2-9

DMAEMA alone <comparative> Mw: 11200, Mn: 4600, Mw/Mn: 2.5

Synthesis Example 2-10

LMA alone <comparative> Mw: 85700, Mn: 18000, Mw/Mn: 4.8

Synthesis Example 2-11

QDM/BMA=1/9<comparative> Mw: 220000, Mn: 5500, Mw/Mn: 40

The abbreviations have the following meanings:

DMAEMA: N,N-dimethylaminoethyl methacrylate

QDM: N,N,N-trimethyl-N-(2-methacryloyloxyethyl)ammonium chloride

LMA: lauryl methacrylate

BMA: butyl methacrylate

MMA: methyl methacrylate

SMA: stearyl methacrylate

St: styrene

<Measurement of Polymer Mw, Mn, and Mw/Mn>

The Mw and Mn were measured by Measurement Method A described above, to calculate Mw/Mn. However, (a'2-2) and (a'2-3) (these notations will be described later) were measured according to Measurement Method B described above.

Hereinafter, synthesis examples of the component (b2) will be described.

Synthesis Example 2-12

Rapeseed oil-derived raw fatty acid (iodine value, 90 g $I_2$/100 g; acid value, 201 mg KOH/g) and triethanolamine were mixed in a reaction molar ratio of 1.85/1 (fatty acid/triethanolamine) and subjected in a usual manner to dehydration condensation reaction, to give a condensate. In the absence of a solvent, this condensate was then subjected in a usual manner to quaternization with dimethylsulfate in an amount of 0.95 equivalent relative to the condensate and then diluted to 90% with ethanol, to give the objective quaternary ammonium salt mixture (also referred to hereinafter as mixture (b21)).

The acid values and iodine values of the raw fatty acid used above and the dehydrated condensates, and the physical properties and composition of the quaternary ammonium salt mixture obtained above are collectively shown in Table 2-1. In Table 2-1, the contents of the amine (compound (b21-3)), the amine monomethyl sulfate (compound (b21-2)), the fatty acid, and the quaternary ammonium salt (compound (b21-1)), all of which are shown in % by mass (shown in the table as "%"), were determined by the following methods.

<Content (%) of Amine>

Using an automatic potentiometric titrator, a sample dissolved in an ethanol solvent was titrated with 0.2 N HCl to determine the total amine value, and the amine content was calculated using the following equation:

Content (%) of amine=(total amine value of quaternary ammonium salt mixture)/(total amine value of dehydrated condensate)×100

<Contents (%) of Amine Monomethyl Sulfate and Fatty Acid>

Using an automatic potentiometric titrator, a sample dissolved in an ethanol solvent was titrated with 0.1 N KOH to determine the acid value. From the acid value, the contents (%) of amine monomethyl sulfate and fatty acid were calculated using the following equations.

Content (%) of amine monomethyl sulfate=(acid value of amine monomethyl sulfate in quaternary ammonium salt mixture)/(theoretical acid value*1 of amine monomethyl sulfate)×100

*1: 56110/(molecular weight*2 of dehydrated condensate+molecular weight of methylsulfate)

*2: 56110/(total amine value of dehydrated condensate)

Content (%) of fatty acid=(acid value of fatty acid in quaternary ammonium salt mixture)/(acid value of raw fatty acid)×100

<Content (%) of Quaternary Ammonium Salt>

The content (%) of quaternary ammonium salt was calculated by using the difference between the solid content shown below and the contents of amine, amine monomethyl sulfate and fatty acid calculated by the methods described above.

<Ethanol Content>

The ethanol content was measured with a volatile matter content measuring instrument.

<Solid Content>

The solid content was calculated as the difference in content between the quaternary ammonium salt mixture and the ethanol.

TABLE 2-1

| | Measurement item | Unit | Synthesis example2-12 [(b2-1)] |
|---|---|---|---|
| Raw fatty acid | Acid value | mgKOH/g | 201 |
| | Iodine value | $gI_2$/100 g | 90 |
| Dehydrated condensate Mixture (b21) | Acid value | mgKOH/g | 1.2 |
| | total amine value | mgKOH/g | 86.9 |
| | Acid value (fatty acid) | mgKOH/g | 0.2 |
| | Acid value (amine monomethyl sulfate) | mgKOH/g | 5 |
| | total amine value | mgKOH/g | 3.2 |
| | Ethanol | % | 10.1 |
| | Fatty acid | % | 0.1 |
| | amine monomethyl sulfate (b21-2) | % | 2.5 |
| | Amine (b21-3) | % | 3.7 |
| | Quaternary ammonium salt (b21-1) | % | 83.6 |
| | (b21-1)/[(b21-2) + (b21-3)] | Mass ratio | 93/7 |

Synthesis Example 2-13

A dehydration amidation reaction between stearic acid and N,N-dimethyl-1,3-propanediamine was used in synthesis. That is, 161 g of N,N-dimethyl-1,3-propanediamine and 284.5 g of stearic acid were introduced into a 4-neck flask equipped with a stirrer, a thermometer and a dehydration tube, and then heated to 180° C. While water formed at this temperature was distilled away for about 5 hours, the mixture was heated under stirring. Thereafter, the reaction solution was cooled to 120° C., the unreacted amine was distilled away under reduced pressure, and the objective N-alkanoylaminopropyl-N,N-dimethylamine was obtained.

The blended components used in the Examples are collectively shown below.

Component (a2)

(a2-1): the polymer obtained in Synthesis Example 2-1
(a2-2): the polymer obtained in Synthesis Example 2-2
(a2-3): the polymer obtained in Synthesis Example 2-3
(a2-4): the polymer obtained in Synthesis Example 2-4
(a2-5): the polymer obtained in Synthesis Example 2-5
(a2-6): the polymer obtained in Synthesis Example 2-6
(a2-7): the polymer obtained in Synthesis Example 2-7
(a2-8): the polymer obtained in Synthesis Example 2-8

Comparative Polymers (a'2-1): the polymer obtained in Synthesis Example 2-9
(a'2-2): the polymer obtained in Synthesis Example 2-10
(a'2-3): the polymer obtained in Synthesis Example 2-11

Component (b2)

(b2-1): the quaternary ammonium salt mixture (mixture (b21)) obtained in Synthesis Example 2-12
(b2-2): N-alkanoylaminopropyl-N,N-dimethylamine obtained in Synthesis Example 2-13

Component (c2)

(c2-1): phenoxyethanol (C log P: 1.19)
(c2-2): polyoxyethylene (average number of moles added: 3) monophenyl ether (C log P: 1.32)
(c2-3): 2-methyl-2,4-pentanediol (C log P: −0.02)
(c2-4): 1,4-cyclohexanedimethanol (C log P: 0.42)

Other Components (m2-1): 2-decyl-1-tetradecylsulfuric acid ester
(d2-1): polyoxyethylene (average number of moles added: 19) monolauryl ether
(d2-2): polyoxyethylene (average number of modes added: 8) monoalkyl (having 9 to 10 carbon atoms) ether
(e2-1): ethylenediaminetetraacetic acid
(f2-1): magnesium chloride
(f2-2): sodium benzoate
(k2-1): ethanol Liquid softener compositions were prepared by the following method, and their stability was evaluated by the following method. The results are shown in Table 2-2.

<Method of Preparing Liquid Softener Composition>

Deionized water weighing 95% of 200 g that was the finished weight of a softener composition to be prepared was introduced into a 300-mL beaker and heated to 60° C. on a water bath. While the water was stirred at 300 rpm with a turbine-type stirrer equipped with 3 stirring blades each having a length of 2 cm, necessary amounts of components (d2) and (e2), and component (c2) in an amount other than a necessary amount described below, were dissolved therein. Then, a mixture (40° C.) wherein necessary amounts of components (b2) and (m2) had been mixed with component (c2) in a necessary amount for previously dissolving them was added thereto. The mixture was stirred for 5 minutes as it was, and components (f2), (k2) and (a2) were added thereto in order, then stirred for 5 minutes and adjusted to objective pH with 62% aqueous p-toluenesulfonic acid and 48% aqueous sodium hydroxide, and deionized water at 60° C. in an amount necessary for the finished weight was added. Thereafter, the mixture was stirred for 10 minutes, then the beaker was transferred to a water bath containing water at 5° C., and the mixture was cooled to 20° C. under stirring. The pH shown in Table 2-2 is pH after cooling (20° C.).

<Method of Evaluating Appearance>

The appearance of the liquid softener composition just after being produced was visually observed and evaluated under the following criteria.

Evaluation Criteria (Appearance)

○: transparent or semitransparent

Δ: slightly clouded x: separated or clouded

<Method of Evaluating Softness>

(Method of Softening Treatment)

Five bath towels (100% cotton) were washed using a commercially available weakly alkaline detergent (Attack, manufactured by Kao Corporation) in a washing machine (dual-bath type washing machine VH-360S1, manufactured by Toshiba Corporation, detergent concentration: 0.0667% by mass, tap water used: 30 L, water temperature: 20° C., 10 minutes). Then, the detergent solution was drained away, the towels were dewatered for 3 minutes, 30 L of tap water was poured into the washing machine, and the towels were rinsed for 5 minutes. After water was drained, the towels were dewatered for 3 minutes. Thereafter, 30 L of tap water was again poured into the washing machine and then 10 ml of the liquid softener composition shown in Table 2-2 was added, followed by stirring for 5 minutes. After that, the bath towels were dewatered and air-dried in a room. This operation was conducted repeatedly 5 times, and the clothes were evaluated for their softness by the following method.

(Evaluation of Softness of the Clothes)

The softness of the clothes treated above were judged according to the following criteria by a panel of 10 examiners (10 males in their thirties) to determine the average of 10 scores. The case where the average was 0 or more to less than 1 was judged to be ○, the case where the average was 1 or more to less than 2 was judged to be Δ and the case where the average was 2 or more was judged to be x.

0: Finished very softly

1: Finished softly

2: Finished slightly softly

3: Not finished softly

TABLE 2-2

| | | | Product of the invention | | | | | | | |
|---|---|---|---|---|---|---|---|---|---|---|
| | | | 2-1 | 2-2 | 2-3 | 2-4 | 2-5 | 2-6 | 2-7 | 2-8 |
| Liquid softener composition | Compounding component (mass %) | (a2-1) | 0.5 | | | | | | | |
| | | (a2-2) | | 0.5 | | | | | | |
| | | (a2-3) | | | 0.5 | | | | | |
| | | (a2-4) | | | | 0.5 | | | | |
| | | (a2-5) | | | | | 0.5 | | | |
| | | (a2-6) | | | | | | 0.5 | | |
| | | (a2-7) | | | | | | | 0.5 | |
| | | (a2-8) | | | | | | | | 0.5 |
| | | (a'2-1) | | | | | | | | |
| | | (a'2-2) | | | | | | | | |
| | | (a'2-3) | | | | | | | | |
| | | (b2-1) | 8.0 | 8.0 | 8.0 | 8.0 | 8.0 | 8.0 | 8.0 | 8.0 |
| | | (b2-2) | 6.0 | 6.0 | 6.0 | 6.0 | 6.0 | 6.0 | 6.0 | 6.0 |
| | | (c2-1) | 12.0 | 12.0 | 12.0 | 12.0 | 12.0 | 12.0 | 12.0 | 12.0 |
| | | (c2-2) | 8.0 | 8.0 | 8.0 | 8.0 | 8.0 | 8.0 | 8.0 | 8.0 |
| | | (c2-3) | | | | | | | | |
| | | (c2-4) | | | | | | | | |
| | | (m2-1) | 4.0 | 4.0 | 4.0 | 4.0 | 4.0 | 4.0 | 4.0 | 4.0 |
| | | (d2-1) | 4.0 | 4.0 | 4.0 | 4.0 | 4.0 | 4.0 | 4.0 | 4.0 |
| | | (d2-2) | | | | | | | | |
| | | (e2-1) | 0.015 | 0.015 | 0.015 | 0.015 | 0.015 | 0.015 | 0.015 | 0.015 |
| | | (f2-1) | | | | | | | | |
| | | (f2-2) | 0.4 | 0.4 | 0.4 | 0.4 | 0.4 | 0.4 | 0.4 | 0.4 |
| | | (k2-1) | 1.2 | 1.2 | 1.2 | 1.2 | 1.2 | 1.2 | 1.2 | 1.2 |
| | | deionized water | Balance | | | | | | | |
| | | Total | 100 | 100 | 100 | 100 | 100 | 100 | 100 | 100 |
| | pH (20° C.) | | 4.0 | 4.0 | 4.0 | 4.0 | 4.0 | 4.0 | 4.0 | 4.0 |
| | appearance | | ○ | ○ | ○ | ○ | ○ | ○ | ○ | ○ |
| | Softening performance | | ○ | ○ | ○ | Δ | ○ | Δ | Δ | ○ |

| | | | Product of the invention | | Comparative product | | | | |
|---|---|---|---|---|---|---|---|---|---|
| | | | 2-9 | 2-10 | 2-1 | 2-2 | 2-3 | 2-4 | 2-5 |
| Liquid softener composition | Compounding component (mass %) | (a2-1) | 0.5 | 0.5 | | | | | |
| | | (a2-2) | | | | | | | |
| | | (a2-3) | | | | | | | |
| | | (a2-4) | | | | | | | |
| | | (a2-5) | | | | | | | |
| | | (a2-6) | | | | | | | |
| | | (a2-7) | | | | | | | |
| | | (a2-8) | | | | | | | |
| | | (a'2-1) | | | | | 0.5 | | |
| | | (a'2-2) | | | | | | 0.5 | |
| | | (a'2-3) | | | | | | | 0.5 |
| | | (b2-1) | 18 | 18 | 8.0 | 18 | 8.0 | 8.0 | 18 |
| | | (b2-2) | | | 6.0 | | 6.0 | 6.0 | |
| | | (c2-1) | | | 12.0 | | 12.0 | 12.0 | |
| | | (c2-2) | | 6.0 | 8.0 | | 8.0 | 8.0 | |
| | | (c2-3) | 5.0 | 9.0 | | 5.0 | | | 5.0 |

TABLE 2-2-continued

| | | | | | | | |
|---|---|---|---|---|---|---|---|
| (c2-4) | 4.0 | 5.0 | | 4.0 | | | 4.0 |
| (m2-1) | | | 4.0 | | 4.0 | 4.0 | |
| (d2-1) | | 4.0 | 4.0 | | 4.0 | 4.0 | |
| (d2-2) | 2.0 | | | 2.0 | | | 2.0 |
| (e2-1) | | 0.015 | 0.015 | | 0.015 | 0.015 | |
| (f2-1) | 1.5 | | | 1.5 | | | 1.5 |
| (f2-2) | | 0.2 | 0.4 | | 0.4 | 0.4 | |
| (k2-1) | 1.0 | 1.0 | 1.2 | 1.0 | 1.2 | 1.2 | 1.0 |
| deionized water | Balance | | | | Balance | | |
| Total | 100 | 100 | 100 | 100 | 100 | 100 | 100 |
| pH (20° C.) | 3.0 | 4.0 | 4.0 | 3.0 | 4.0 | 4.0 | 3.0 |
| appearance | ○ | ○ | ○ | ○ | X | X | X |
| Softening performance | ○ | ○ | X | X | ○ | X | Δ |

Hereinafter, synthesis examples of the component (a3) and comparative polymers will be described.

Synthesis Example 3-1

A 1-L glass separable flask was flushed with nitrogen for a predetermined time. 46.8 g of ethanol was introduced into the flask and heated under stirring until the inner temperature reached 78 to 80° C., and then the ethanol was kept at this temperature. A solution prepared by uniformly mixing 300.00 g of dimethylaminoethyl methacrylate, 7.11 g of 2,2'-azobis(2,4-dimethylvaleronitrile) (V-65B manufactured by Wako Pure Chemical Industries, Ltd.) and 114.3 g of ethanol was added dropwise at a predetermined rate to the flask over 3 hours. Then, a solution prepared by dissolving 11.85 g of V-65B in 47.4 g of ethanol was added dropwise at a predetermined rate to the flask over 4 hours. After dropwise addition was finished, the mixture was kept at about 80° C. for 2 hours, thereby yielding a solution of polydimethylaminoethyl methacrylate as polymer (a3-1) in ethanol. The Mw and Mw/Mn of polymer (a3-1) were 11200 and 2.5, respectively. The composition of polymer (a3-1) analyzed by $^1$H-NMR was the same as in the charged monomer composition.

Synthesis Example 3-2

252.0 g of deionized water was introduced into a 1-L glass separable flask and stirred in a nitrogen atmosphere for a predetermined time. The deionized water was heated to about 70° C. An aqueous solution prepared by uniformly mixing 215.00 g of 78% aqueous solution of methacryloyloxyethyltrimethylammonium chloride (manufactured by Mitsubishi Gas Chemical Co., Inc.) with 55.5 g of deionized water, and an aqueous solution prepared by dissolving 0.88 g of 2,2'-azobis(2,4-dimethylvaleronitrile) (V-50 manufactured by Wako Pure Chemical Industries, Ltd.) in 37.8 g of deionized water, both of which had been flushed with nitrogen, were simultaneously dropwise added thereto over 2 hours, thereby being polymerized. Thereafter, the reaction solution was aged by keeping it at about 70° C. for 10 hours. Thereafter, the reaction solution was concentrated to give 32.7% aqueous solution of polymethacryloyloxyethyltrimethylammonium chloride as polymer (a3-4). The Mw and Mw/Mn of polymer (a3-4) were 270000 and 20, respectively. The composition of polymer (a3-4) analyzed by $^1$H-NMR was the same as in the charged monomer composition.

Hereinafter, synthesis examples of the component (b3) will be described.

Synthesis Example 3-3

Rapeseed oil-derived raw fatty acid (iodine value, 90 g $I_2$/100 g; acid value, 201 mg KOH/g) and triethanolamine were mixed in a reaction molar ratio of 1.85/1 (fatty acid/triethanolamine) and subjected in a usual manner to dehydration condensation reaction, to give a condensate. In the absence of a solvent, this condensate was then subjected in a usual manner to quaternization with dimethylsulfate in an amount of 0.95 equivalent relative to the condensate and then diluted to 90% with ethanol, to give the objective quaternary ammonium salt mixture (also referred to hereinafter as mixture (b31)).

The acid value and iodine value of the raw fatty acid used above and of the dehydrated condensate, and the physical properties and composition of the quaternary ammonium salt mixture obtained above are collectively shown in Table 3-1. In Table 3-1, the contents of amine (compound (b31-3)), amine monomethyl sulfate (compound (b31-2)), fatty acid, and quaternary ammonium salt (compound (b31-1)), all of which are shown in % by mass (shown in the table as "%"), were determined by the following methods.

The content (%) of amine, the contents (%) of amine monomethyl sulfate and fatty acid, the content (%) of quaternary ammonium salt, the content of ethanol, and the solid content were measured or calculated in the same manner as described above.

TABLE 3-1

| | Measurement item | Unit | Synthesis example 3-3 [(b3-1)] |
|---|---|---|---|
| Raw fatty acid | Acid value | mgKOH/g | 201 |
| | Iodine value | $gI_2$/100 g | 90 |
| Dehydrated condensate Mixture (b31) | Acid value | mgKOH/g | 1.2 |
| | Total amine value | mgKOH/g | 86.9 |
| | Acid value (fatty acid) | mgKOH/g | 0.2 |
| | Acid value (aminemonomethyl sulfate) | mgKOH/g | 5 |
| | Total amine value | mgKOH/g | 3.2 |
| | Ethanol | % | 10.1 |
| | Fatty acid | % | 0.1 |
| | Amine monomethyl sulfate (b31-2) | % | 2.5 |
| | Amine (b31-3) | % | 3.7 |
| | Quaternary ammonium salt (b31-1) | % | 83.6 |
| | (b31-1)/[(b31-2) + (b31-3)] | Mass ratio | 93/7 |

Synthesis Example 3-4

A dehydration amidation reaction between stearic acid and N,N-dimethyl-1,3-propanediamine was used in synthesis. That is, 161 g of N,N-dimethyl-1,3-propanediamine and 284.5 g of stearic acid were introduced into a 4-neck flask equipped with a stirrer, a thermometer and a dehydration tube, and then heated to 180° C. While water formed at this temperature was distilled away for 5 hours, the mixture was heated under stirring. Thereafter, the reaction solution was cooled to 120° C., the unreacted amine was distilled away under reduced pressure, and the objective N-alkanoylaminopropyl-N,N-dimethylamine was obtained.

The blended components used in the Examples are collectively shown below.

Component (a3)

(a3-1): the polymer obtained in Synthesis Example 3-1 (polydimethylaminoethyl methacrylate, Mw: 11200)

(a3-2): PAA-HC1-03 (polyallylamine hydrochloride, Mw: 3000) manufactured by Nitto Boseki Co., Ltd.

(a3-3): PAS-H-5L (polydiallyldimethylammonium chloride, Mw: 40000) manufactured by Nitto Boseki Co., Ltd.

(a3-4): the polymer (polymethacryloyloxyethyltrimethylammonium chloride, Mw: 270000) obtained in Synthesis Example 3-2

The molecular weight (Mw) of the component (a3) was calculated by measurement with GPC (polyethylene glycol-equivalent molecular weight) using, as a solvent, 50 mmol/L LiBr solution prepared in a mixed solvent of (1% acetic acid/ethanol):water=3:7 (mass ratio)

Component (b3)

(b3-1): the quaternary ammonium salt mixture (mixture (b31)) obtained in Synthesis Example 3-3

(a3-2): N-alkanoylaminopropyl-N,N-dimethylamine obtained in Synthesis Example 3-4

Component (c3)

(c3-1): phenoxyethanol (C log P: 1.19)

(c3-2): polyoxyethylene (average number of moles added: 3) monophenyl ether (C log P: 1.32)

Component (d3)

(d3-1): polyoxyethylene (average number of moles added: 19) monolauryl ether (compound having the structure of the formula (3-5-1))

(d3-2): Ethoquad C/25 manufactured by Lion Corporation (polyoxyethylene (average number of moles added: 15) alkyl (having 8 to 18 carbon atoms) methylammonium chloride (compound having the structure of the formula (3-6-2))

Other Components (m3-1): 2-decyl-1-tetradecylsulfuric acid ester (e3-1): ethylenediaminetetraacetic acid (f3-1): sodium benzoate (k3-1): ethanol Liquid softener compositions (3) were prepared by the following method, and their stability was evaluated by the following method. The results are shown in Table 3-2.

<Method of Preparing Liquid Softener Composition (3)>

Deionized water weighing 95% of 200 g that was the finished weight of a softener composition to be prepared was introduced into a 300-mL beaker and heated to 60° C. on a water bath. While the water was stirred at 300 rpm with a turbine-type stirrer equipped with 3 stirring blades each having a length of 2 cm, necessary amounts of components (m3) and (e3), and component (c3) in an amount other than a necessary amount described below, were dissolved therein. Then, a mixture (40° C.) wherein necessary amounts of components (b3) and (d3) had been mixed with component (c3) in a necessary amount for previously dissolving them was added thereto. The mixture was stirred for 5 minutes as it was, and then components (f3), (k3) and (a3) were added thereto in order, then stirred for 5 minutes and adjusted to objective pH with 62% aqueous p-toluenesulfonic acid solution and 48% aqueous sodium hydroxide, and deionized water at 60° C. in an amount necessary for the finished weight was added. Thereafter, the mixture was stirred for 10 minutes, then the beaker was transferred to a water bath containing water at 5° C., and the mixture was cooled to 20° C. under stirring. The pH shown in Table 3-2 is pH after cooling (20° C.).

<Method of Evaluating Appearance>

The appearance of the liquid softener composition just after being produced was visually observed and evaluated under the following criteria.

Evaluation Criteria (Appearance)

○: transparent or semitransparent

Δ: slightly clouded x: separated or clouded

<Method of Evaluating Softness>

(Method of Softening Treatment)

Five bath towels (100% cotton) were washed using a commercially available weakly alkaline detergent (Attack, manufactured by Kao Corporation) in a washing machine (dual-bath type washing machine VH-360S1, manufactured by Toshiba Corporation, detergent concentration: 0.0667% by mass, tap water used: 30 L, water temperature: 20° C., 10 minutes). Then, the detergent solution was drained away, the towels were dewatered for 3 minutes, 30 L of tap water was poured into the washing machine, and then the towels were rinsed for 5 minutes. After water was drained, the towels were dewatered for 3 minutes. Thereafter, 30 L of tap water was again poured into the washing machine and then 10 ml of the liquid softener composition shown in Table 3-2 was added, followed by stirring for 5 minutes. After that, the bath towels were dewatered and air-dried in a room. This operation was conducted repeatedly 5 times, and the clothes were evaluated for their softness by the following method.

(Evaluation of Softness of the Clothes)

The softness of the clothes treated above were judged according to the following criteria by a panel of 10 examiners (10 males in their thirties) to calculate the average of scores by the 10 examiners. An evaluation value of 2.0 or more can be recognized to be excellent in softening effect, and a difference in 0.4 between evaluation values can be sufficiently recognized as a significant difference.

−1: Not finished softly as compared with the clothes treated with the composition in Comparative Example 3-1.

0: Equivalent to the clothes treated with the composition in Comparative Example 3-1.

1: Finished slightly softly as compared with the clothes treated with the composition in Comparative Example 3-1.

2: Finished softly as compared with the clothes treated with the composition in Comparative Example 3-1.

3: Finished very softly as compared with the clothes treated with the composition in Comparative Example 3-1.

TABLE 3-2

| | | | Product of the invention | | | | | | |
|---|---|---|---|---|---|---|---|---|---|
| | | | 3-1 | 3-2 | 3-3 | 3-4 | 3-5 | 3-6 | 3-7 |
| Liquid softener composition | Compounding component (mass %) | (a3-1) | 0.2 | 0.5 | 2.0 | 4.0 | | | |
| | | (a3-2) | | | | | | 0.5 | |
| | | (a3-3) | | | | | 0.5 | | 0.5 |
| | | (a3-4) | | | | | | | |
| | | (b3-1) | 8.0 | 8.0 | 8.0 | 8.0 | 8.0 | 18.0 | 18.0 |
| | | (b3-2) | 6.0 | 6.0 | 6.0 | 6.0 | 6.0 | | |

TABLE 3-2-continued

| | | | | | | | | |
|---|---|---|---|---|---|---|---|---|
| | (c3-1) | 10.5 | 10.5 | 10.5 | 10.5 | 10.5 | 7.0 | 7.0 |
| | (c3-2) | 7.5 | 7.5 | 7.5 | 7.5 | 7.5 | 5.0 | 5.0 |
| | (d3-1) | 6.0 | 6.0 | 5.0 | 5.0 | 12.0 | 6.0 | 10.0 |
| | (d3-2) | | | | | | | |
| | (m3-1) | 4.0 | 4.0 | 4.0 | | 4.0 | | |
| | (e3-1) | 0.015 | 0.015 | 0.015 | 0.015 | 0.015 | 0.015 | 0.015 |
| | (f3-1) | | | | | 0.75 | | 0.25 |
| | (k3-1) | 2.0 | 2.0 | 2.0 | 2.0 | 2.0 | 2.0 | 2.0 |
| | deionized water | Balance | | | | | | |
| | Total | 100 | 100 | 100 | 100 | 100 | 100 | 100 |
| | pH (20° C.) | 4.0 | 4.0 | 4.0 | 3.0 | 4.0 | 4.0 | 4.0 |
| | appearance | ○ | ○ | ○ | ○ | ○ | ○ | ○ |
| | Softening performance | 2.0 | 2.5 | 3.0 | 2.5 | 2.0 | 2.0 | 2.0 |

| | | | Product of the invention | | Comparative product | | | |
|---|---|---|---|---|---|---|---|---|
| | | | 3-8 | 3-9 | 3-1 | 3-2 | 3-3 | 3-4 |
| Liquid softener composition | Compounding component (mass %) | (a3-1) | | 0.5 | | | 0.5 | |
| | | (a3-2) | | | | | | |
| | | (a3-3) | | | | | | 0.5 |
| | | (a3-4) | 0.5 | | | | | |
| | | (b3-1) | 18.0 | 18.0 | 8.0 | 18.0 | 8.0 | 18.0 |
| | | (b3-2) | | | 6.0 | | 6.0 | |
| | | (c3-1) | 7.0 | 7.0 | 10.5 | 7.0 | 10.5 | 7.0 |
| | | (c3-2) | 5.0 | 5.0 | 7.5 | 5.0 | 7.5 | 5.0 |
| | | (d3-1) | 10.0 | 4.0 | 6.0 | 6.0 | 4.0 | 4.0 |
| | | (d3-2) | | 2.0 | | | | |
| | | (m3-1) | | | 4.0 | | 4.0 | |
| | | (e3-1) | 0.015 | 0.015 | 0.015 | 0.015 | 0.015 | 0.015 |
| | | (f3-1) | 0.25 | 0.25 | | 0.25 | | 0.25 |
| | | (k3-1) | 2.0 | 2.0 | 2.0 | 2.0 | 1.2 | 2.0 |
| | | deionized water | Balance | | Balance | | | |
| | | Total | 100 | 100 | 100 | 100 | 100 | 100 |
| | | pH (20° C.) | 4.0 | 5.0 | 4.0 | 4.0 | 4.0 | 4.0 |
| | | appearance | ○ | ○ | ○ | ○ | X | X |
| | | Softening performance | 2.0 | 2.5 | 0.0 | 0.5 | 2.5 | 2.0 |

The invention claimed is:

1. A liquid softener composition, having pH 2 to 5 at 20° C. and comprising the following components (a1), (b1) and (c1), the content of the component (a1) being 0.1 to 5.0% by mass, the content of the component (b1) being 4 to 25% by mass, the content of the component (c1) being 20 to 95% by mass:

component (a1): a polymer compound having a weight-average molecular weight of 2,000 to 90,000 and comprising a monomer unit (A1) derived from a compound represented by the following formula (1-1) or derived from an acid salt thereof and a monomer unit (B1) derived from alkyl (C8 to C18) acrylates or alkyl (C8 to C18) methacrylates at an (A1)/(B1) molar ratio of from 55/45 to 98/2:

(1-1)

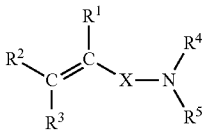

wherein $R^1$ and $R^2$ independently represent a hydrogen atom or a methyl group, $R^3$ represents a hydrogen atom or —COOM wherein M is a hydrogen atom or an alkali metal atom; X represents —COO—$R^6$—, —CONR$^7$—$R^8$—, or —$CH_2$—;

when X is —$CH_2$—, $R^4$ represents a group represented by the formula (1-3):

(1-3)

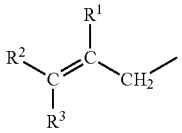

when X is other than —$CH_2$—, $R^4$ represents a methyl group or a hydroxyalkyl group having 1 to 3 carbon atoms; $R^5$ represents a methyl group, a hydroxyalkyl group having 1 to 3 carbon atoms, or a hydrogen atom; $R^6$ and $R^8$ independently represent an alkyl group having 2 to 3 carbon atoms; and $R^7$ represents a hydrogen atom or an alkyl group having 1 to 3 carbon atoms, component (b1): at least one compound selected from the group consisting of compounds represented by the following formulae (1-4) and (1-5):

(1-4)

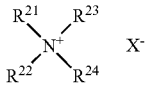

(1-5)

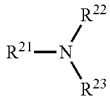

in formulae (1-4) and (1-5), $R^{21}$, $R^{22}$ and $R^{23}$ independently represent a hydrocarbon group having 14 to 26 carbon atoms in total which is interrupted by an ester group and/or an amide group, a hydroxyalkyl group having 1 to 3 carbon atoms, or an alkyl group having 1 to 3 carbon atoms, at least one of which is a hydrocarbon group having 14 to 26 carbon atoms in total which is interrupted by an ester group and/or an amide group; $R^{24}$ represents a hydrogen atom or an alkyl group having 1 to 3 carbon atoms; and $X^-$ represents an anionic group; and component (c1): at least one compound selected from the group consisting water and solvents having a Clog P value of 2 or less.

2. The liquid softener composition according to claim 1, wherein the total molar ratio of the monomer units (A1) and (B1) to the total monomer units of the polymer compound as the component (a1) is 60 to 100%.

3. The liquid softener composition according to claim 1 or 2, which comprises 40 to 95% by mass of the component (c 1).

4. A method of treating a washed fiber product, which comprises adding the liquid softener composition according to claim 1 to an aqueous solution adjusted to pH 2 to 9.

5. A method of conferring softness and soil releasability on a fiber product, which comprises adding the liquid softener composition according to claim 1 to an aqueous solution adjusted to pH 2 to 9 and treating a washed fiber product with the solution.

6. A method of washing a fiber product, comprising the steps of:

treating the fiber product with the liquid softener composition according to claim 1, and washing the treated fiber product with a cleaning solution having a pH value of 9 to 13.

7. The liquid softener composition according to claim 1, wherein the monomer unit (B1) is derived from alkyl (C12 to C18) acrylates or alkyl (C12 to C18) methacrylates.

8. The liquid softener composition according to claim 1, wherein the monomer unit (A1) is derived from a compound represented by the following formula (1-1) or derived from an acid salt thereof:

(1-1)

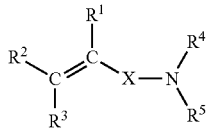

wherein $R^1$ and $R^2$ independently represent a hydrogen atom or a methyl group, $R^3$ represents a hydrogen atom; X represents —COO—$R^6$—, or —CONR$^7$—$R^8$—;

$R^4$ represents a methyl group or a hydroxyalkyl group having 1 to 3 carbon atoms; $R^5$ represents a methyl group, a hydroxyalkyl group having 1 to 3 carbon atoms, or a hydrogen atom; $R^6$ and $R^8$ independently represent an alkyl group having 2 to 3 carbon atoms; and $R^7$ represents a hydrogen atom or an alkyl group having 1 to 3 carbon atoms.

9. The liquid softener composition according to claim 1, wherein the (A1)/(B1) molar ratio is from 60/40 to 95/5.

* * * * *